US012037149B2

(12) United States Patent
Ross et al.

(10) Patent No.: US 12,037,149 B2
(45) Date of Patent: Jul. 16, 2024

(54) ROLLED PAPER PRODUCT ARRAYS

(71) Applicant: The Procter & Gamble Company, Cincinnati, OH (US)

(72) Inventors: Kari Beth Ross, Loveland, OH (US); Barret L. Bender, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 169 days.

(21) Appl. No.: 17/868,908

(22) Filed: Jul. 20, 2022

(65) Prior Publication Data

US 2023/0034310 A1 Feb. 2, 2023

Related U.S. Application Data

(60) Provisional application No. 63/227,512, filed on Jul. 30, 2021.

(51) Int. Cl.
*B65D 85/672* (2006.01)
*B65B 25/14* (2006.01)

(52) U.S. Cl.
CPC ..... *B65B 25/146* (2013.01); *B65D 85/672* (2013.01)

(58) Field of Classification Search
CPC .. B65D 85/07; B65D 85/672; B65D 2203/00; B65B 25/146; B65B 25/148; A47K 10/16
USPC ..... 206/389, 391, 394, 440, 459.5, 494; 604/385.01, 385.02
See application file for complete search history.

(56) References Cited

U.S. PATENT DOCUMENTS

| | | | | |
|---|---|---|---|---|
| 7,931,632 | B2 * | 4/2011 | Betts | A61F 13/551 206/440 |
| 7,998,127 | B2 * | 8/2011 | Betts | A47F 3/00 206/440 |
| 9,242,775 | B2 * | 1/2016 | Knobloch | B65D 71/00 |
| 2006/0168914 | A1 * | 8/2006 | Steeves-Kiss | A47K 10/16 162/125 |
| 2007/0095705 | A1 * | 5/2007 | Legault | B65D 75/00 206/459.5 |
| 2008/0078685 | A1 * | 4/2008 | Patterson | B65D 85/07 206/391 |
| 2008/0128308 | A1 * | 6/2008 | Betts | G09F 23/00 206/440 |
| 2008/0202964 | A1 * | 8/2008 | Knobloch | B65D 71/00 206/394 |
| 2008/0245491 | A1 * | 10/2008 | Knobloch | D21H 27/002 206/391 |

* cited by examiner

*Primary Examiner* — Luan K Bui
(74) *Attorney, Agent, or Firm* — Richard L. Alexander

(57) ABSTRACT

The present disclosure discloses arrays (retail store shelves and digital retail) of disposable, fibrous, rolled products comprising Traditional Diameter Rolls and Packages and Larger Diameter Rolls and Packages.

22 Claims, 16 Drawing Sheets

ROLLED PAPER PRODUCT ARRAYS

CROSS REFERENCE TO RELATED APPLICATION

This application claims the benefit of U.S. Provisional Application No. 63/227,512, filed Jul. 30, 2021, the substance of which is incorporated herein by reference.

FIELD OF THE INVENTION

The present disclosure relates to rolled paper products in packages in arrays.

BACKGROUND OF THE INVENTION

Rolled products, rolled absorbent products, and rolled fibrous products such as paper towels, toilet tissue, disposable shop towels, and wipes, for example, are sometimes packaged as a plurality of rolls. In some instances, the packages may have two or more rolls stacked in a side-by-side fashion with another two or more rolls. In some configurations, individually wrapped packages of the two or more rolls, or stacks of rolls, may be packaged. Individually wrapped packages or naked rolls may be stacked or positioned together into a generally cuboid-shaped bundle. In some configurations, packages of the present disclosure may comprise rolls that have a larger diameter (e.g., 6.7 inches or more for paper towels, 5.9 inches or more for toilet paper) than traditional diameter (e.g., 6.6 inches or less for paper towels, 5.85 inches or less for toilet paper) rolls that are presently available.

There are several challenges with offering packages comprising larger rolls. One is communicating to the consumer which packages contain the larger rolls. Even though larger roll packages may be larger, traditional roll packages are also often larger due to higher volume of rolls per package. Another challenge is communicating the value of the larger roll format. Surprisingly, one way of overcoming this is by placing the packages comprising Larger Diameter Rolls between packages comprising traditional roll diameters, for example, such that the larger roll diameter offering is centered (e.g., a center column of a shelf array offering of Bounty) for the purpose of communicating that it is a premier (to the purchaser/user, as well as to the retailer) format of the array. This is a counter-intuitive placement as one may expect the diameter of the offering to increase or decrease from left to right or from top to bottom of the array. Particularly, in combination with between-placement or centered-placement, it may be beneficial to place packages of the smallest roll diameter offering next to the largest roll diameter offering to emphasize its value. This is particularly useful when the larger or largest diameter roll offering package communicates how many of the small or smallest diameter rolls equates to the new larger diameter roll offering. Seeing the offerings next to each other offers this functional relationship of allowing the consumer to better appreciate or comprehend the value of the new larger diameter offering as opposed to communicating an abstract idea.

Further, as packages comprising Larger Diameter Rolls may have a larger front face (i.e., aisle-facing faces) Surface Areas, it may, surprisingly, not be desirable to increase the Surface Area of the brand or trademark indicia on them to the same extent that front package face Surface Area of the larger diameter roll package increases versus the front package face Surface Area of the traditional diameter roll packages. In this way, Face-to-Brand Indicia Ratios (front face Surface Area divided by the brand indicia Surface Area) of the larger roll diameter packages may be larger than the Face-to-Brand Indicia Ratios of traditional diameter roll packages. This is contrary to expectations as larger package faces normally equate to equally larger brand icons or indicia. By not increasing the Surface Area of brand/trademark indicia on larger roll diameter package faces, there is room to communicate critical information about the new formats, such as the larger diameter roll's scale and properties—without this information, a consumer cannot know the appropriate use of the larger diameter roll (e.g., that the larger diameter roll is for residential use, that it is as soft or softer than traditionally sized rolls, that it is meant for the kitchen, that it can or cannot fit onto certain types of roll holders, that it is still the same height, its sheet equivalence versus traditionally sized rolls, etc.).

One way of communicating the scale of the Larger Diameter Rolls inside the package is to have a clear window exposing the inner contents of the package. It may be desirable that the clear window runs across a side face (such as a front face) of the package, as well as across a top or bottom face of the package. Instead of using clear plastic, however, which may not be perceived as a premium package feature, it may be desirable to illustrate the inner package contents by using graphical representations of the Larger Diameter Rolls in the package on the front and/or the top faces of the package, such that at least partial side and top profiles of the Larger Diameter Rolls are illustrated. It may be further desirable that the roll profile illustrations are approximately to scale (or at least within about 5%, 10%, 15%, or 20%, including all 1% increments therebetween) of the Larger Diameter Rolls in the package. In an array, such as a shelf display, with the larger diameter roll packages, it may be desirable that the packages comprising traditionally sized rolls do not have such clear windows or to-scale or near-to-scale roll representations so that the larger diameter roll packages better stand out and so the message doesn't get lost or diluted across the package offerings.

Greater details about each of these considerations are disclosed below.

DETAILED DESCRIPTION OF THE INVENTION

Figure 1A:
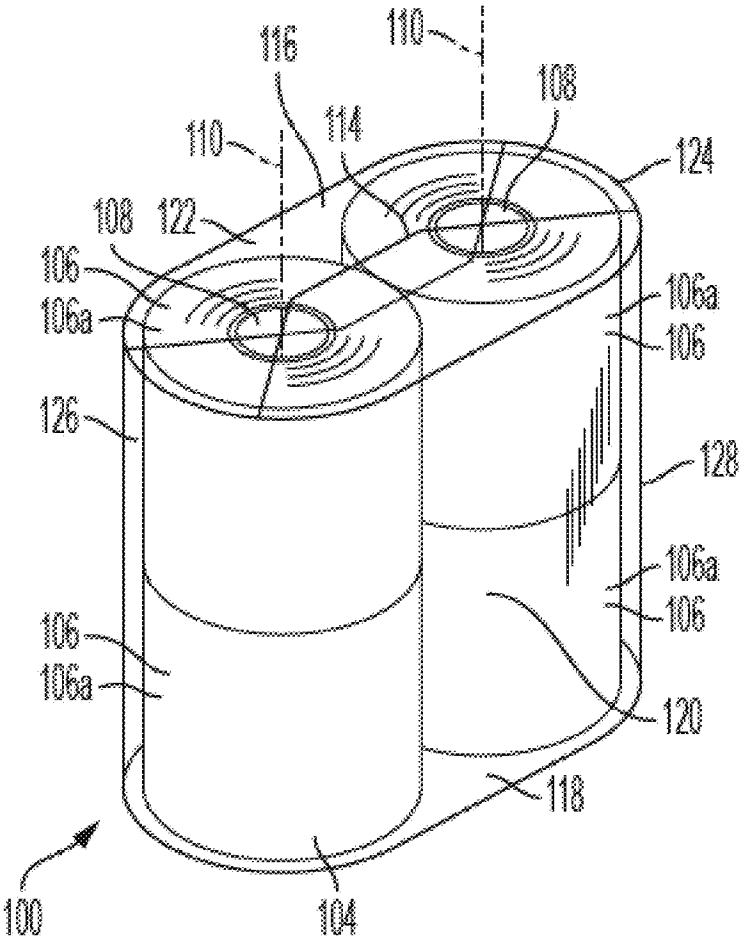
FIG. 1A is a simplified perspective view of a package of absorbent paper product.

The following term explanations may be useful in understanding the present disclosure:

"Fibrous structure" as used herein means a structure (web) that comprises one or more fibers. Non-limiting examples of processes for making fibrous structures include known wet-laid fibrous structure making processes, air-laid fibrous structure making processes, meltblowing fibrous structure making processes, co-forming fibrous structure making processes, and spunbond fibrous structure making processes. Such processes typically include steps of preparing a fiber composition, oftentimes referred to as a fiber slurry in wet-laid processes, either wet or dry, and then depositing a plurality of fibers onto a forming wire or belt such that an embryonic fibrous structure is formed, drying and/or bonding the fibers together such that a fibrous structure is formed, and/or further processing the fibrous structure such that a finished fibrous structure is formed. The fibrous structure may be a through-air-dried fibrous structure and/or conventionally dried fibrous structure. The fibrous structure may be creped or uncreped. The fibrous structure may exhibit differential density regions or may be substantially uniform in density. The fibrous structure may be pattern densified, conventionally felt-presses and/or high-bulk, uncompacted. The fibrous structures may be homogenous or multilayered in construction.

After and/or concurrently with the forming of the fibrous structure, the fibrous structure may be subjected to physical transformation operations such as embossing, calendering, selfing, printing, folding, softening, ring-rolling, applying additives, such as latex, lotion and softening agents, combining with one or more other plies of fibrous structures, and the like to produce a finished fibrous structure that forms and/or is incorporated into a sanitary tissue product.

"Sanitary tissue product" as used herein means a wiping implement for post-urinary and/or post-bowel movement cleaning (referred to as "toilet paper," "toilet tissue," or "toilet tissue product"), for otorhinolaryngological discharges (referred to as "facial tissue" or "facial tissue product") and/or multi-functional absorbent and cleaning uses (referred to as "paper towels," "paper towel products," "absorbent towels," "absorbent towel products," such as paper towel or "wipe products").

The sanitary tissue products of the present invention may comprise one or more fibrous structures and/or finished fibrous structures.

The sanitary tissue products of the present invention may exhibit a basis weight between about 10 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue product of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$.

The sanitary tissue products of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present invention may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in). Two or more sanitary tissue products within an array of sanitary tissue products according to the present invention may exhibit different total dry tensile strengths.

In one example, one sanitary tissue product in an array of sanitary tissue products according to the present invention exhibits a total dry tensile strength of greater than 216 g/cm (550 g/M) and another sanitary tissue product within the array exhibits a total dry tensile strength of less than 216 g/cm (550 g/in).

In another example, the sanitary tissue products of the present invention may exhibit a total dry tensile strength of greater than about 315 g/cm (800 g/in) and/or greater than about 354 g/cm (900 g/in) and/or greater than about 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present invention may exhibit a total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present invention may exhibit a density of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may be in any suitable form, such as in a roll, in individual sheets, in connected, but perforated sheets, in a folded format or even in an unfolded.

The sanitary tissue products of the present invention may comprise additives such as softening agents, temporary wet strength agents, permanent wet strength agents, bulk softening agents, lotions, silicones, and other types of additives suitable for inclusion in and/or on sanitary tissue products. In one example, the sanitary tissue product, for example a toilet tissue product, comprises a temporary wet strength resin. In another example, the sanitary tissue product, for example an absorbent towel product, comprises a permanent wet strength resin.

"Array" means a display of packages, often in a retail setting on the same side of an aisle or generally across an aisle from each other, the packages often comprising disposable, fibrous, sanitary tissue products of different constructions (such that the products are compositionally and/or structurally different e.g., different fibers or different fiber blends, different chemistries, different embossments, different properties and/or characteristics, etc.). The packages may have the same brand and/or sub-brand (or at least common sub-brand portions) and/or the same trademark registration and/or may have been manufactured by or for a common company. The packages may be available at a common point of sale. An array is marketed as a line-up of products normally having like packaging elements (e.g., packaging material type, film, paper, dominant color, design theme, same color pallet, design architecture, etc.) that convey to consumers that the different individual packages are part of a larger line-up. Arrays often have the same brand name, for example, "Bounty," and same sub-brand (or portion of the sub-brand), for example, a plurality of packages may have "Essentials," or a plurality of packages may have "Ultra." A different product in the array may have the same brand "Bounty" and the sub-brand, or portion of the sub-brand name (these may also be referred to as identifiers or additional information indicia), may be different: a first package may display "Bounty" and may also display "Ultra Strong," and a second package may display "Bounty" and may also display "Ultra Soft." The differences between "Charmin Ultra Soft" and "Charmin Ultra Strong" or the differences between "Bounty" and "Bounty Essentials" may include product form, application style, or other structural and/or functional elements intended to address the differences in consumer needs or preferences for such products. Furthermore, the packaging is distinctly different in that "Charmin Ultra Strong" is packaged in a predominately red packaging (or with dominant red signals) and "Charmin Ultra Soft" is packaged in a predominately blue packaging (or with dominant blue signals).

More broadly speaking, part of an array may be located in a physical store, while another part of the array is offered on-line. For instance, an array may include "Charmin Ultra Soft," Charmin Ultra Strong," and "Charmin Ultra Eco." "Charmin Ultra Soft" and "Charmin Ultra Strong" may be available physically in stores on shelf displays in near proximity to one another, while "Charmin Ultra Eco" is only available on-line, but each could be considered part of an array. In this example, each product is branded as "Charmin," each has the same sub-brand or sub-brand portion "Ultra" to indicate that it is a premium version of the product. And, all three products are manufactured by or on behalf of The Procter & Gamble Company. In a like example, three different product types having different brand names, but the same sub-brand or additional information, and manufactured by or on behalf of the same company may be part of an array. For example, "Bounty Ultra Eco," Charmin Ultra Eco," and "Puffs Ultra Eco," each manufactured by The Procter & Gamble Company may be considered part of the same array.

"Digital Array" means an array of packages (or at least a portion of an array) represented digitally on a digital display (computer, tablet, phone, etc.). While the digital packages are just images, said images of packages represents actual packages comprising actual sanitary tissue products.

"Ply" or "plies" as used herein means an individual finished fibrous structure optionally to be disposed in a substantially contiguous, face-to-face relationship with other plies, forming a multiple ply ("multi-ply") sanitary tissue product. It is also contemplated that a single-ply sanitary tissue product can effectively form two "plies" or multiple "plies", for example, by being folded on itself.

"Indicia" as used herein means an identifier and/or indicator and/or hint and/or suggestion, of the nature of a property of something, such as an intensive property of a sanitary tissue product.

"Textual indicia" as used herein means a text indicia, such as a word and/or phrase that communicates to a consumer a property about the sanitary tissue product it is associated with. In one example, a sanitary tissue product, such as a toilet tissue product, is housed in a package comprising a textual indicia; namely, the word "Strong."

"Brand name" as used herein means a single source identifier, in other words, a brand name identifies a product and/or service as exclusively coming from a single commercial source (i.e., company). An example of a brand name is Charmin, which is also a trademark. Brand names are nonlimiting examples of textual indicia. The sanitary tissue products of the present invention may be marketed and/or packaged under a common brand name (i.e., the same brand name, such as Charmin®). In addition to the brand name, a product descriptor may also be associated with the sanitary tissue products, such as "Ultra Strong" and/or "Ultra Soft" for example).

"Non-textual indicia" as used herein means a non-text indicia that communicates to a consumer through a consumer's senses. In one example, a non-textual indicia may communicate, even intuitively communicate, to a consumer through sight (visual indicia), through touch (texture indicia), sound (audio indicia) and/or through smell (scent indicia).

"Basis Weight" as used herein is the weight per unit area of a sample reported in lbs/3000 $ft^2$ or $g/m^2$. The basis weight is measured herein by the basis weight test method described in the Test Methods section herein.

"Dry Tensile Strength" (or simply "Tensile Strength" as used herein) of a fibrous structure of the present invention and/or a sanitary tissue product comprising such fibrous structure is measured according to the Tensile Strength Test Method described herein.

"Softness" as used herein means the softness of a fibrous structure according to the present invention and/or a sanitary tissue product comprising such fibrous structure, which is determined according to a human panel evaluation wherein the softness of a test product is measured versus the softness of a control or standard product. The resulting number is a relative measure of softness between the two fibrous structures and/or sanitary tissue products. The softness is measured herein by the softness test method described in the Test Methods section herein.

"Absorbency" as used herein means the characteristic of a fibrous structure according to the present invention and/or a sanitary tissue product comprising such fibrous structure, which allows it to take up and retain fluids, particularly water and aqueous solutions and suspensions. In evaluating the absorbency of paper, not only is the absolute quantity of fluid a given amount of paper will hold significant, but the rate at which the paper will absorb the fluid is also. Absorbency is measured herein by the Horizontal Full Sheet (HFS) test method described in the Test Methods section herein.

"Lint" as used herein means any material that originated from a fibrous structure according to the present invention and/or sanitary tissue product comprising such fibrous structure that remains on a surface after which the fibrous structure and/or sanitary tissue product has come into contact. The lint value of a fibrous structure and/or sanitary tissue product comprising such fibrous structure is determined according to the Lint Test Method described herein.

"Texture" as used herein means any pattern present in the fibrous structure. For example, a pattern may be imparted to the fibrous structure during the fibrous structure-making process, such as during a through-air-drying step. A pattern may also be imparted to the fibrous structure by embossing the finished fibrous structure during the converting process and/or by any other suitable process known in the art.

"Color" as used herein, means a visual effect resulting from a human eye's ability to distinguish the different wavelengths or frequencies of light. The apparent color of an object depends on the wavelength of the light that it reflects. While a wide palette of colors can be employed herein, it is preferred to use a member selected from the group consisting of orange, purple, lavender, red, green, blue, yellow, and violet. The method for measuring color is described in the Color Test Method described herein.

"Rolled product(s)" as used herein include fibrous structures, paper, and sanitary tissue products that are in the form of a web and can be wound about a core. For example, rolled sanitary tissue products can be convolutedly wound upon itself about a core or without a core to form a sanitary tissue product roll and can be perforated into the form of discrete sheets, as is commonly known for toilet tissue and paper towels.

Figure 1B:
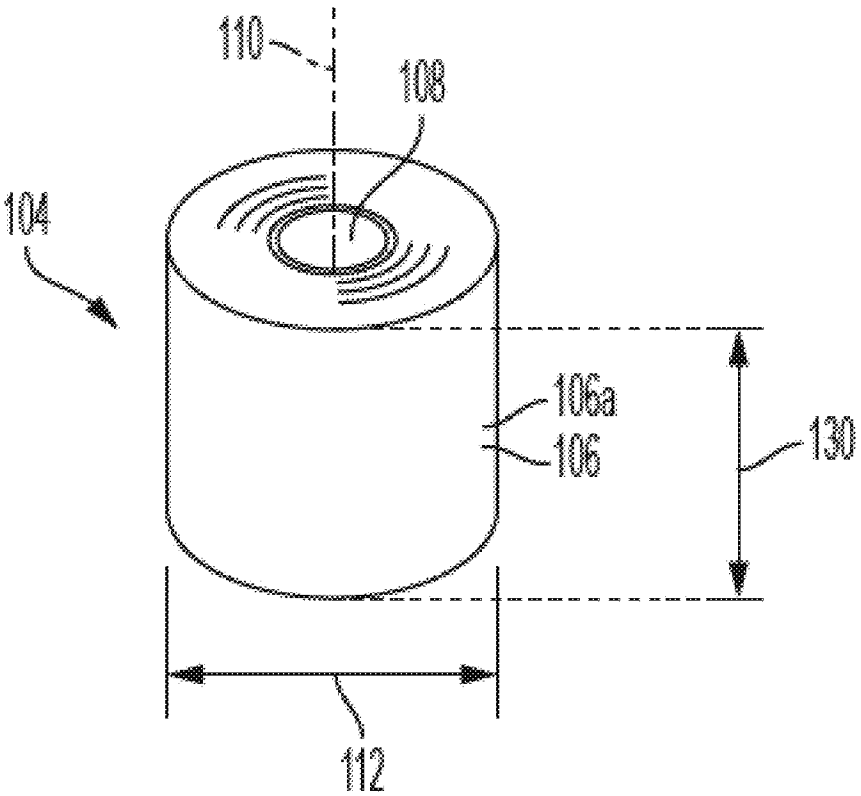
FIG. 1B is a simplified perspective view of a rolled paper product.

FIG. 1A shows a simplified perspective illustration of a package 100 of absorbent paper product 104. As shown in FIG. 1B, the absorbent paper product 104 may be configured as rolled paper product 106, rolled product, rolls of product, and/or rolls. "Rolled products" or "rolled paper products" or "rolls of product" or "rolls" within the present disclosure may include products made from cellulose fibers, nonwoven fibers, other suitable fibers, and combinations thereof. In some configurations, rolled products can be made of, or partially made of recycled fibers. Disposable rolled products or disposable rolled absorbent products or disposable rolled paper products may comprise paper towels, facial tissues, toilet tissues, shop towels, wipes, and the like, which may be made from one or more webs of fibers, such as cellulose fibers or nonwoven fibers, for example. Rolled paper products may comprises an absorbent towel substrate, a sanitary tissue substrate, or a cellulosic fiber containing substrate. With continued reference to FIG. 1B, each roll 106*a* of rolled paper product 106 may be wound about a paper, cardboard, paperboard, or corrugate tube to form a core 108 through each roll 106*a*. Each core 108 may define a longitudinal axis 110 extending therethrough. In some configurations, the rolls 106*a* of rolled paper product 106 may not include the paper, cardboard, paperboard, or corrugate tube, but instead, the rolls of product may be wound about itself to form a roll while still forming a core defined through each roll. The void area in the center of each roll where the product winds about itself can be considered a "core" for purposes of this disclosure, although such rolls may be referred to as "coreless" rolls.

Rolled paper products 106 may have a "Roll Height" 130 (see FIG. 1B) and a "Roll Diameter" 112 (see FIG. 1B). It is to be appreciated that rolled paper products 106 herein may be provided in various different sizes, and may comprise various different roll diameters 112. For example, in some configurations, the roll diameter 112 of the rolled paper product 106 may be from about 4 inches to about 8 inches, specifically reciting all 0.05 inch increments within the above-recited ranges and all ranges formed therein or thereby. In some configurations, the roll diameter 112 of the rolled paper product 106 may be from about 6 inches to about 14 inches, specifically reciting all 0.05 inch increments within the above-recited ranges and all ranges formed therein or thereby. It is also to be appreciated that the rolled paper product 106 may comprise various different roll densities, which may be measured according to the Roll Density Test Method described herein. For example, in some configurations, the rolled paper product 106 may comprise a roll density greater than or equal to about 0.03 g/cm$^3$ and less than or equal to about 0.32 g/cm$^3$, specifically reciting all 0.01 g/cm$^3$ increments within the above-recited ranges and all ranges formed therein or thereby. In some configurations, the rolled paper product 106 may comprise a roll density greater than or equal to about 0.05 g/cm$^3$ and less than or equal to about 0.20 g/cm$^3$, specifically reciting all 0.01 g/cm$^3$ increments within the above-recited ranges and all ranges formed therein or thereby.

The packages 100 that house the absorbent paper product 104 may be formed from various types of material and may be configured in various shapes and sizes. In some configurations, the packages 100 may be formed from a poly film material that may comprise polymeric films, polypropylene films, and/or polyethylene films. In some configurations, the packages 100 may be formed from cellulose, such as for example, in the form of paper and/or cardboard. The package 100 may have a preformed shape into which absorbent paper products 104 are inserted and/or may be formed by wrapping a material around one or more absorbent paper products 104 to define a shape that conforms with the shapes of individual products and/or arrangements of products. As shown in FIG. 1A, the package 100 may also include a seal 114, such as an envelope seal, for example, formed thereon. As shown in FIG. 1A, the package 100 may include a top side 116 and a bottom side 118. The package 100 may also include a front panel 120 and a rear panel 122, wherein the front and rear panels 120, 122 are connected with and separated by opposing first and second sides 124, 126. The front panel 120, the rear panel 122, the first side 124, and/or the second side 126 may be substantially planar, curved, or convex as shown in FIG. 1A and may also define an outer surface 128 of the package 100. Note, "panel" may alternatively be referred to herein as "face" (e.g., front face). The panel configured to face a customer when she walks down an aisle of a retail store may be referred to as an "aisle facing" face or panel of the package 100. Packages 100 may have a "Package Height" 210 (see FIG. 2A), a "Package Width" 212 (see FIG. 2A), and a "Package Depth" 214 (see FIG. 2B). At least one of the panels or faces of the packages in an array may have an indicia 300 indicating a common brand name, sub-brand name, identifier, and/or common manufacturer. Referring to FIG. 3, each of the first package 201, second package 202, third package 203, and fourth package 204 may comprise common brand name indicia 300, but comprise different sub-brand names and/or additional information indicia 301, 302, 303, and 304. The brand names may be indicia on the viewable surface of the package or, alternatively, may be embossed as part of the texture of the roll substrate. Each of the first package 201, second package 202, third package 203, and fourth package 204 may be manufactured and/or marketed by the same company (e.g., The Procter & Gamble Company).

Figure 1C:
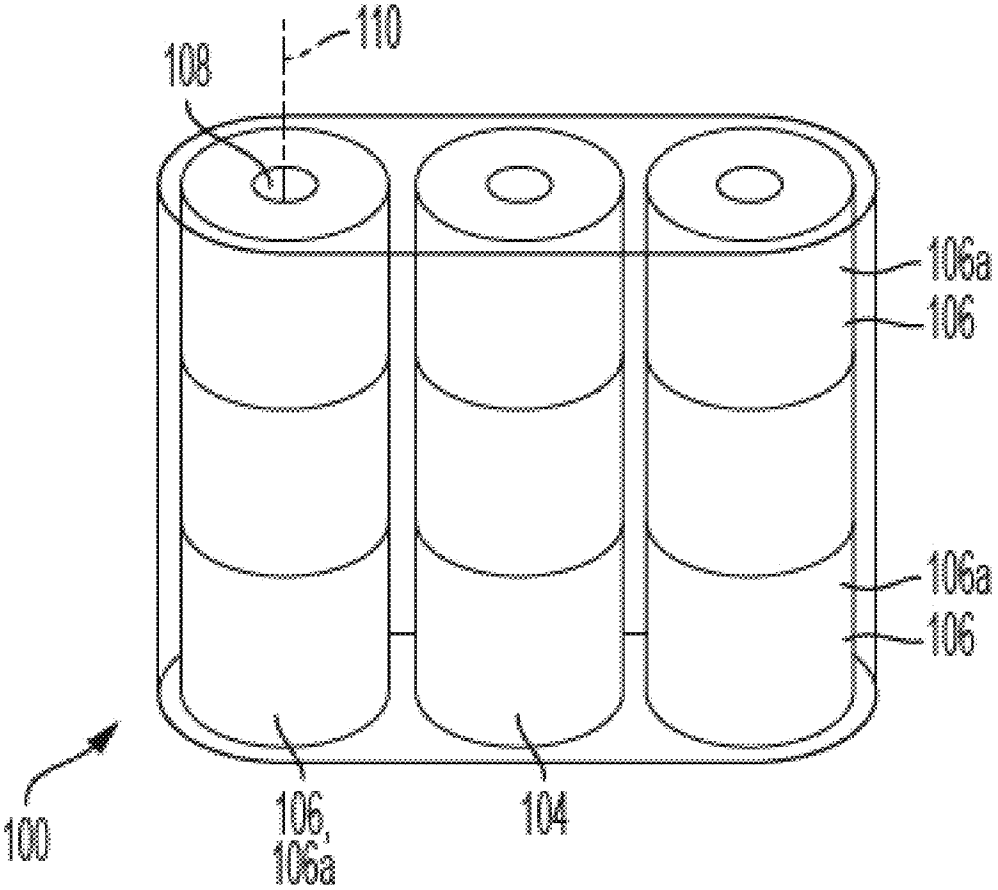
FIG. 1C is a simplified perspective view of a package of absorbent paper product.
Figure 1D:
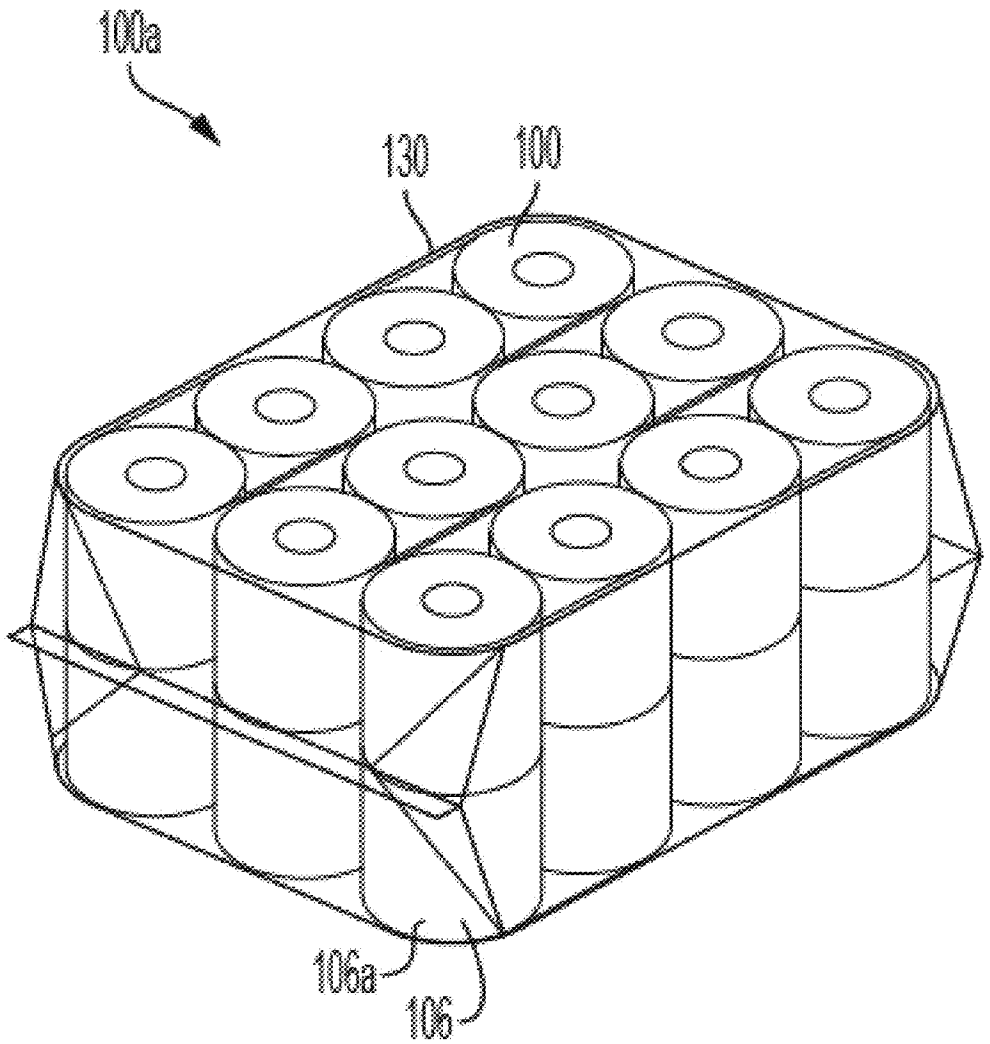
FIG. 1D is a simplified perspective view of a package including individually wrapped inner packages of absorbent paper product.

It is to be appreciated that the packages 100 may include various quantities of absorbent paper products 104 that may be arranged in various orientations within the package 100. For example, as shown in FIG. 1A, an individually wrapped package 100 may include four rolls of rolled paper product 106 inside a package 100, wherein two rolls 106*a* are stacked on another two rolls 106*a*. The longitudinal axis 110 of each of the cores 108 of each stack of at least two rolls 106*a* may be generally parallel and aligned with each other and adjacent stack(s) of at least two rolls 106*a* can lie in generally the same plane as the other stack(s) of at least two rolled paper products 106. In another example, shown in FIG. 1C, an individually wrapped package 100 may include nine rolls 106*a* of rolled paper product 106 arranged in stacks inside the package 100. It is to be appreciated that multiple rolls 106*a* of rolled paper product 106 can be enclosed in a package 100 constructed from a polymer film or other suitable material that may be sealed to form individually wrapped packages 100. In some configurations, individually wrapped packages 100 of the two or more rolls 106*a*, or stacks of rolls 106*a*, may be bundled and/or bound together within an overwrap 130 forming a package 100 to define a large count package 100*a*, such as shown in FIG. 1D. In some configurations, large count packages 100*a* may contain a plurality of "naked," (i.e., unwrapped) rolls 106*a* of rolled paper product 106. In some configurations, the individually wrapped packages or naked rolls may be stacked or positioned together into a generally cuboid-shaped package 100, such as disclosed in U.S. Patent Publication No. 2012/0205272 A1, which is incorporated by reference herein. It is to be appreciated that packages 100 can each comprise one or more rolls 106*a* of rolled paper product 106, such as for example, two, three, four, six, eight, nine, ten, twelve, or fifteen rolls of rolled paper product.

Arrays of the Present Disclosure

Figure 2A:
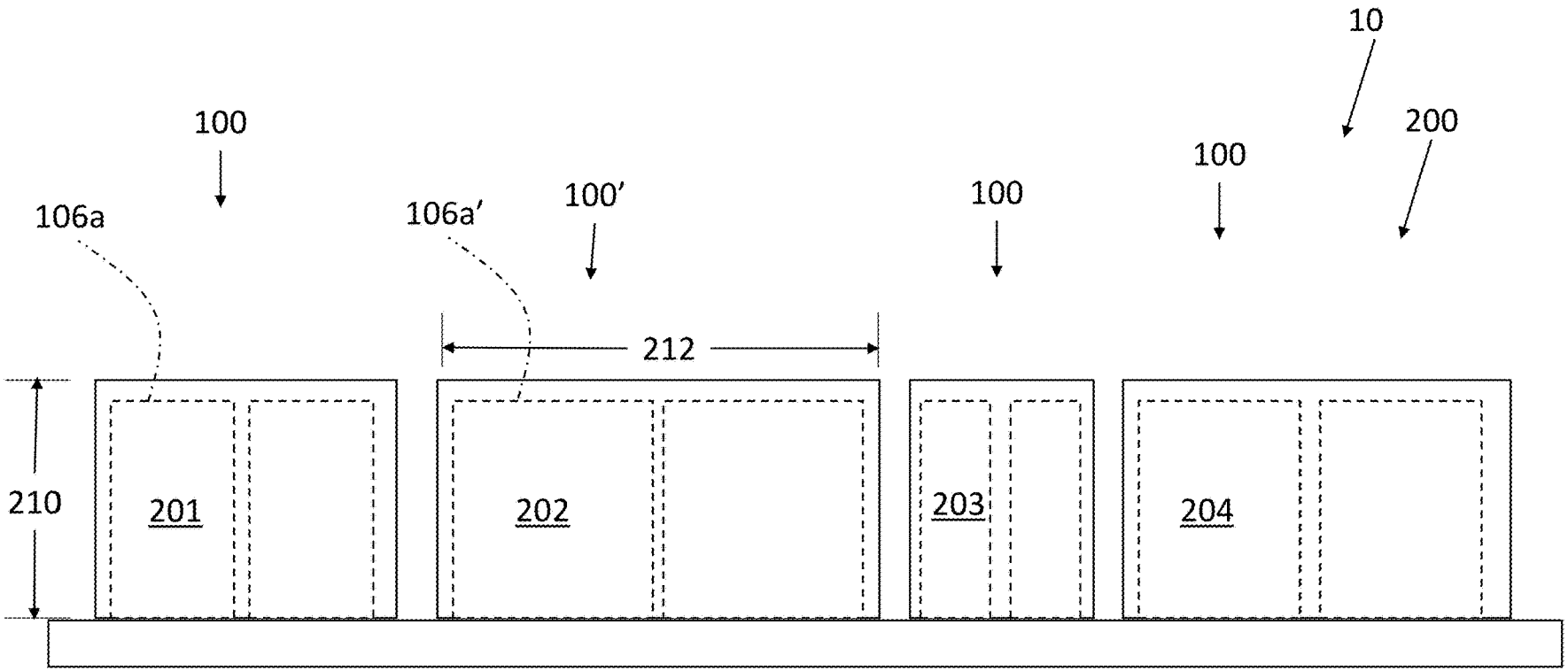
FIG. 2A is a simplified front side view of an array of packages on a retail store shelf.
Figure 2B:
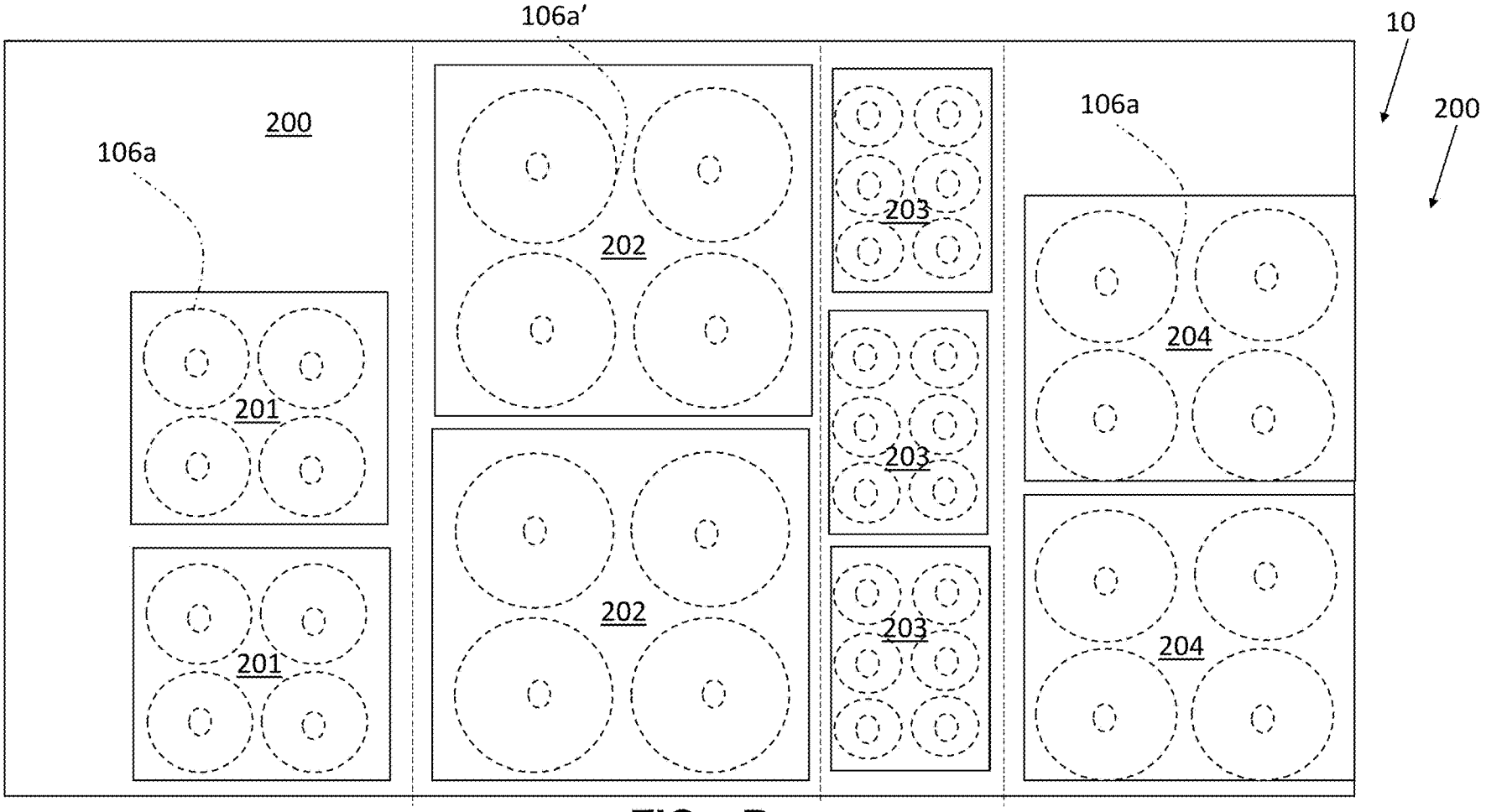
FIG. 2B is a simplified top view of the array of packages of FIG. 2A.
Figure 2C:
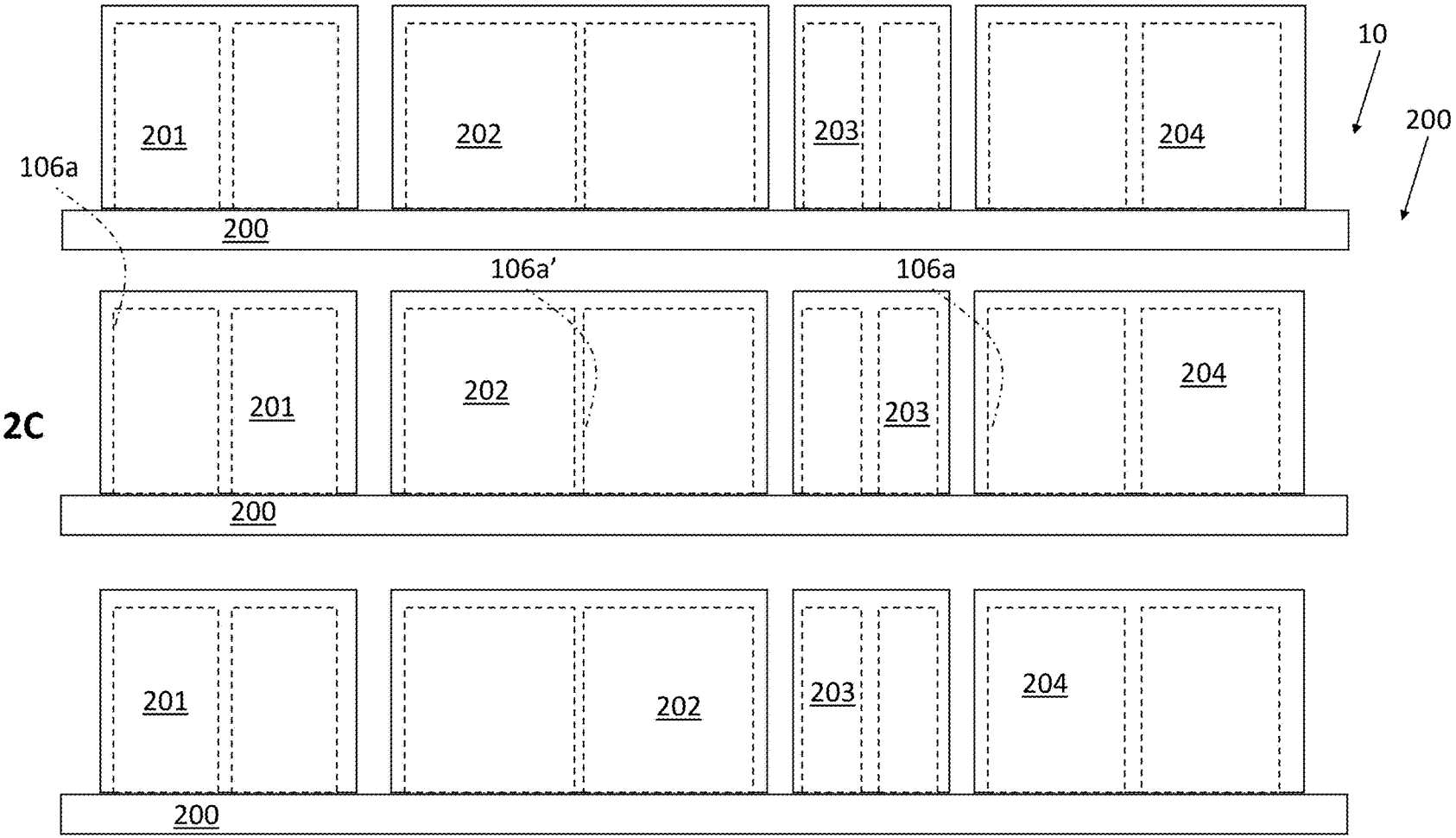
FIG. 2C is a simplified front side view of an array of packages on a retail store shelf.
Figure 2D:
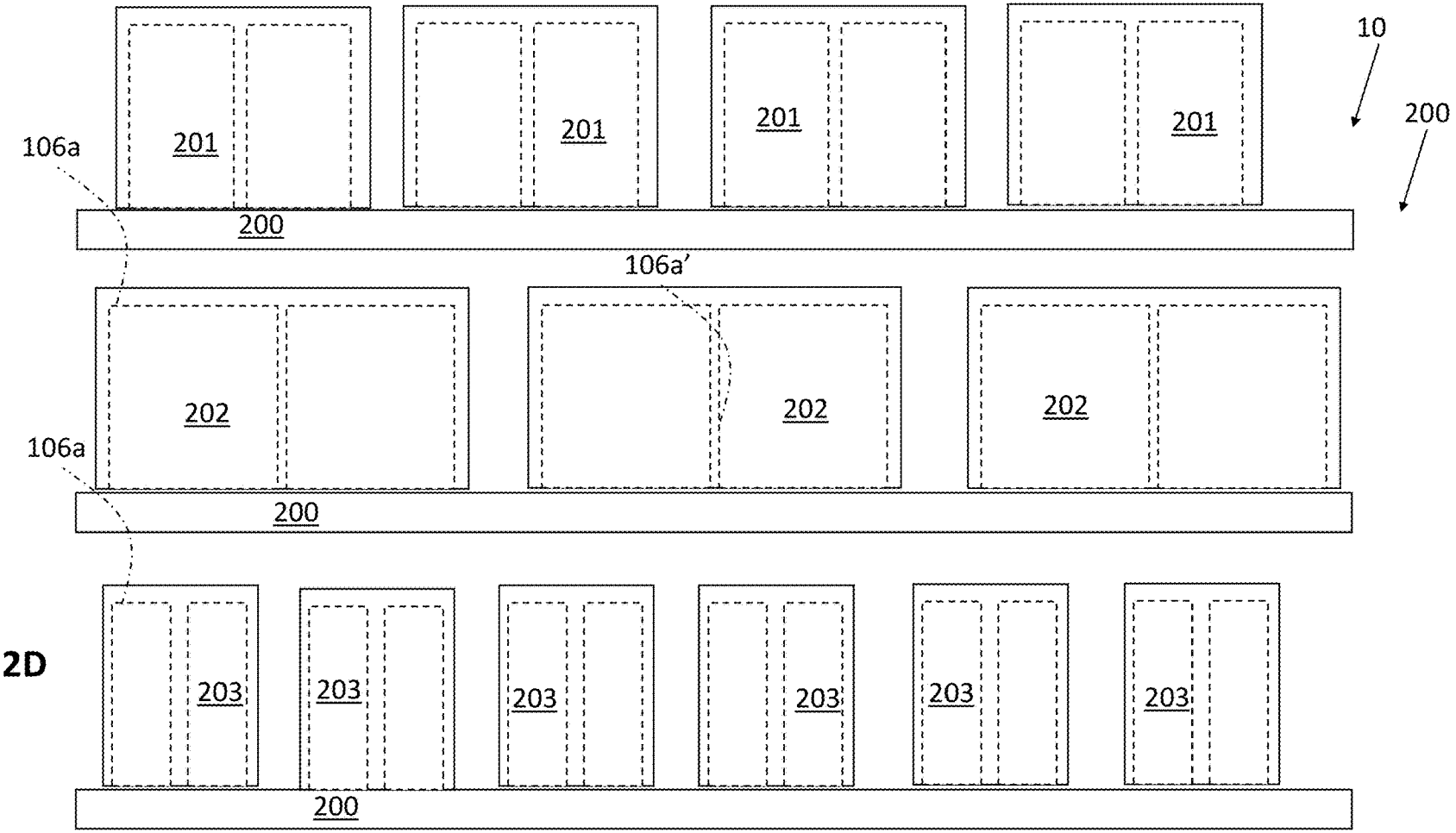
FIG. 2D is a simplified front side view of an array of packages on a retail store shelf.
Figure 3:
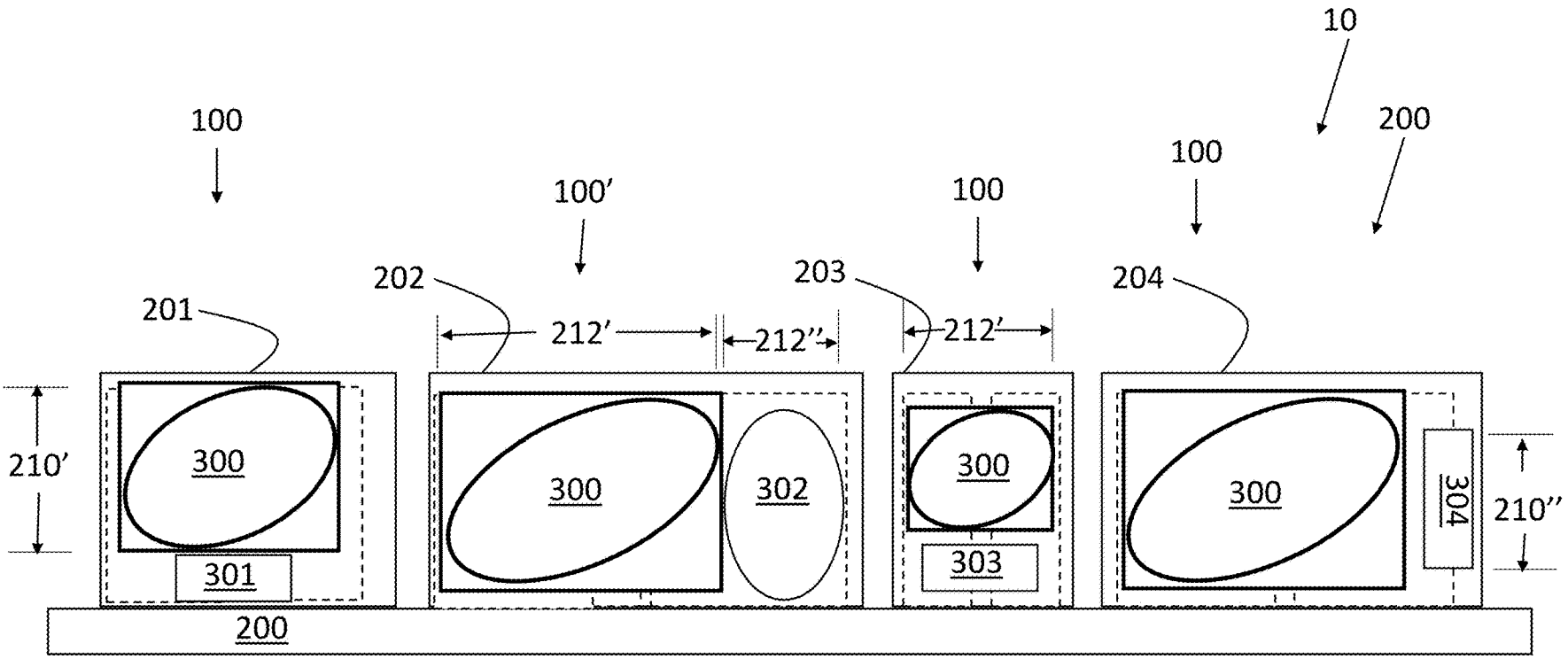
FIG. 3 is a simplified front side view of an array of packages on a retail store shelf.

As shown in FIGS. 2A-3, a retail store shelf 200 in a retail setting (e.g., Target, Walmart, Meijer, etc.) may comprise an array 10 of disposable, fibrous, rolled products (e.g., rolled paper products 106, roll(s) of rolled paper products 106*a*) of the present disclosure. The array 10 may comprise a first package 201 comprising a first front face 120 disposed as aisle (i.e., the path a customer walks adjacent to the shelf 200) facing. The first package 201 may comprise a first plurality (i.e., 2 or more rolls) of disposable, fibrous, rolled products 106. The first plurality of disposable, fibrous, rolled products 106 may comprise a first average Roll Diameter 112 of 5.85 inches or less for toilet paper, or 6.60 inches or less for paper towels (referred to herein as "Traditional Diameter Rolls" and the packages containing them as "Traditional Roll Packages"). Still referring to FIGS. 2A and 2B, on the same shelf 200, a second package 202 may comprise a second front face 120 disposed as aisle facing. The second package 202 may comprise a single, disposable, fibrous, rolled product 106 or a second plurality (i.e., 2 or more rolls) of disposable, fibrous, rolled products 106 having a second average Roll Diameter 112 of 5.90 inches or greater for toilet paper, or 6.70 inches or greater for paper towels (referred to herein as "Larger Diameters Rolls" and the packages containing them as "Larger Roll Packages").

Further, for toilet paper, the second average Roll Diameter (for Larger Diameter Rolls) may be greater than 5.90, 6.00, 6.20, 6.40, or 6.60 inches, and the second average Roll Diameter (for Larger Diameter Rolls) may be 22.00, 20.00, 18.00, 16.00, 14.00, 12.00, 10.00, 8.00, 7.00, or less inches, specifically reciting all 0.1 inch increments within the above-recited ranges and all ranges formed therein or thereby. For toilet paper, the second average Roll Diameter (for Larger Diameter Rolls) may be from 6.00 inches to about 22.00 inches, from about 6.20 inches to about 12.00 inches, from about 6.40 inches to about 12.00 inches, or from about 6.60 inches to about 8.00 inches, specifically reciting all 0.1 inch increments within the above-recited ranges and all ranges formed therein or thereby.

Further, for paper towels, the second average Roll Diameter (for Larger Diameter Rolls) may be greater than 6.60, 6.70, 6.80, 7.00, 7.20, or 7.40 inches, and the second average Roll Diameter (for Larger Diameter Rolls) may be 22.00, 20.00, 18.00, 16.00, 14.00, 12.00, 10.00, 8.00, or less inches, specifically reciting all 0.1 inch increments within the above-recited ranges and all ranges formed therein or thereby. For paper towels, the second average Roll Diameter (for Larger Diameter Rolls) may be from 6.60 inches to about 22.00 inches, from about 6.80 inches to about 18.00 inches, from about 7.00 inches to about 12.00 inches, or from about 7.20 inches to about 8.00 inches, specifically reciting all 0.1 inch increments within the above-recited ranges and all ranges formed therein or thereby.

As shown in FIG. 2A, the second front face 120 of the second package 202 (comprising Larger Diameter Rolls) may have a larger "Surface Area" (Package Length 212× Package Height 210) than the first front face 120 of the other packages in the array, including the first package 201, the third package 203, and the fourth package 204 (each comprising Traditional Diameter Rolls) due to the Larger Diameter Rolls the second package 202 contains. The front face Surface Area of the package comprising Larger Diameter Rolls may be about 5%, 10%, 15%, 20%, 25%, 30%, 40%, 50%, or 60%, including all 1% increments therebetween, greater than the front face Surface Area of packages comprising Traditional Diameter Rolls.

Still referring to FIGS. 2A-3, the second front face 120 of the second package 202 may be formed by multiple rolls. Due to the Larger Diameter Rolls forming its second front face 120, the second package 202 (a Larger Roll Package) may, therefore, be wider 212 than the other packages in the array, including the first package 201, the third package 203, and the fourth package 204 (each comprising Traditional Diameter Rolls). Referring to FIG. 2B, the second package 202 may also have a Package Depth 214 greater than the Package Depth 214 of the other packages in the array, including the first package 201, the third package 203, and the fourth package 204 (each comprising Traditional Diameter Rolls). Shelf columns comprising Traditional Diameter Rolls (e.g. 224) may comprise more packages than shelf columns (e.g., 222) comprising Larger Diameter Rolls.

Figure 4:
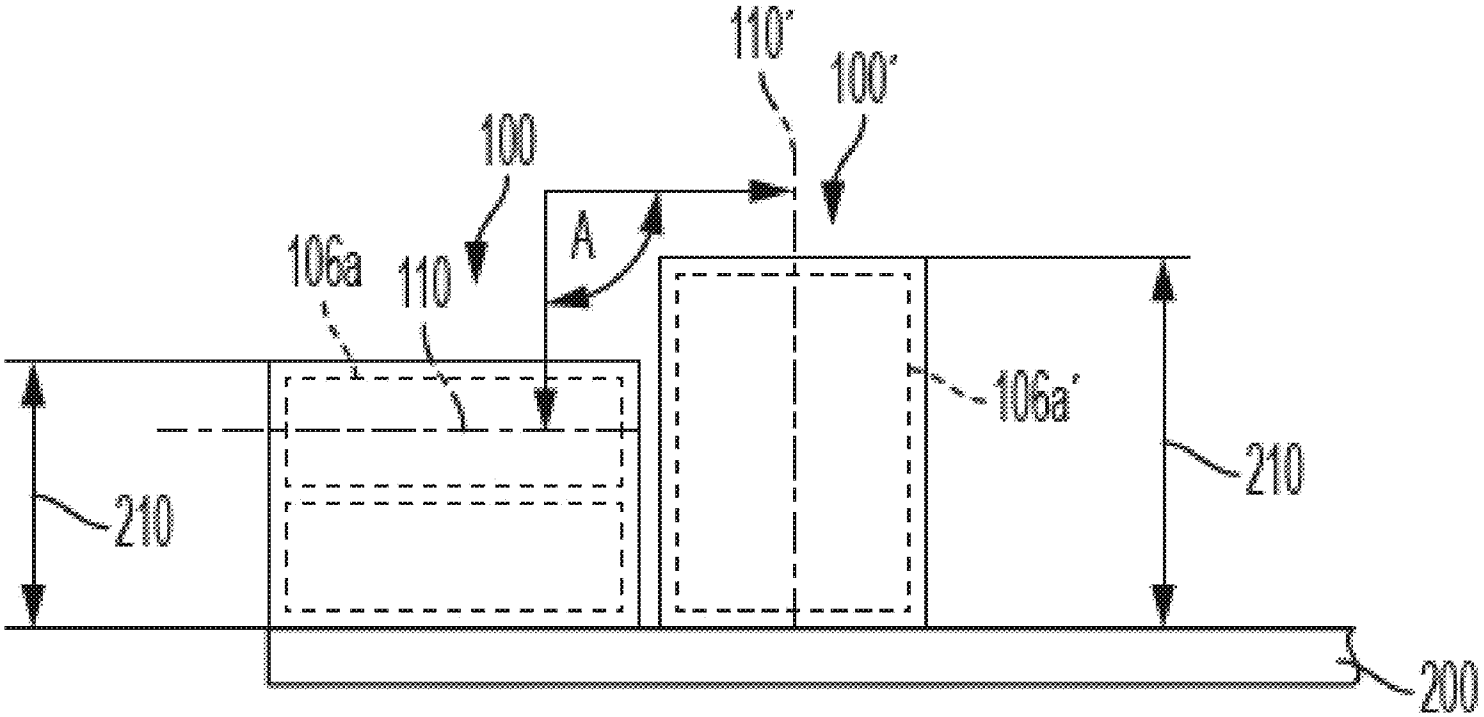
FIG. 4 is a simplified front side view of an array of packages on a retail store shelf.
Figure 5:
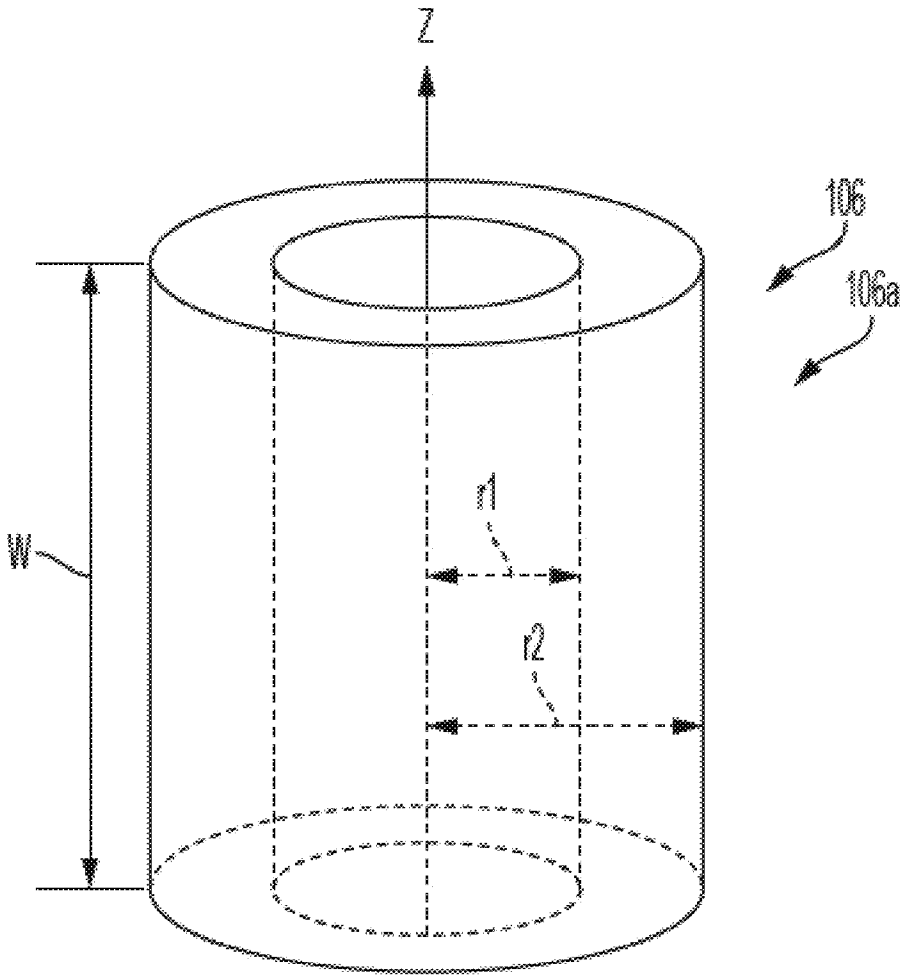
FIG. 5 is a schematic representation of a rolled paper product roll for use in measuring a rolled paper product roll's Roll Density as measured according to the Roll Density Test Method described herein.

Referring to FIGS. 2A, C, and D, the first, second, third, and fourth packages may have the same Package Height 210. Alternatively, referring to FIG. 4, the first package 100 (comprising Traditional Diameter Rolls) may have an on-shelf Package Height 210 less than the second package 100' (comprising Larger Diameter Rolls). Still referring to FIG. 4, the first disposable, fibrous, rolled products rolls 106*a* may be are oriented 90 degrees (A) from the second disposable, fibrous, rolled products rolls 106*a*' as they are oriented in the first 201 and second packages 202 on the retail store shelf. Referring further to FIG. 4, the first disposable, fibrous, rolled products rolls 106*a* (Traditional Diameter Rolls) may be oriented in the same direction the second disposable, fibrous, rolled products rolls 106*a*' (Larger Diameter Rolls) as they are oriented in the first 100 and second packages 100' on the retail store shelf.

Referring to FIGS. 2A-3, the array 10 may comprise a third package 203 comprising a third front face 120 disposed as aisle facing. The third package may comprise a third plurality of disposable, fibrous, rolled products rolls 106*a* (Traditional Diameter Rolls) having a third average Roll Diameter 112. The average Roll Diameter 112 of the rolls 106 of the third package 203 may be smaller than the second package and the third front face 120 of the third package 203 may have a smaller Surface Area than the second front face 120 of the second package 202. Of interest, placing the second packages 202 comprising the Larger Diameter Rolls between packages comprising the smallest (of the array) of the traditional sized rolls serves an important utility. Specifically, this disposition, as illustrated in FIGS. 2A-3, where package 202 is immediately adjacent to packages 201 and 203, helps to emphasize the value of the largest (of the array)

diameter rolls. It may be further desirable and useful when the largest (of the array) diameter roll offering package communicates how many of the smallest (of the array) diameter rolls equates to the new largest diameter roll offering. Seeing the offerings next to each other offers this functional relationship of allowing the consumer to better appreciate or comprehend the value of the new largest diameter offering because the rolls are right there to evaluate versus communication of an abstract idea.

Also in FIGS. 2A, B and 3, the array 10 may comprise a fourth package 204 comprising a fourth front face 120 disposed as aisle facing. The fourth package may comprise a fourth plurality of disposable, fibrous, rolled products rolls 106*a* (Traditional Diameter Rolls) having a fourth average Roll Diameter 112. The average Roll Diameter 112 of the rolls 106 of the fourth package 204 may be smaller than the average Roll Diameter of the rolls of the second package, but may have an average Roll Diameter larger than the rolls of the first and third packages, 201 and 203, respectively. Further, the fourth front face 120 of the fourth package 204 may have a smaller Surface Area than the second front face 120 of the second package 202, and the fourth front face 120 of the fourth package 204 may have a larger Surface Area than the first front face 120 of the first package 201 and a larger Surface Area than the third front face 120 of the third package 203. So, in the illustrated example of FIGS. 2A, B and 3, the fourth package 203 comprises the next-to-largest (of the array) Roll Diameters and the next-to-largest (of the array) Surface Area of the front face of the package. To keep this fourth package from confusing the scale and value of the second package of largest (of the array) Roll Diameters, the fourth package 204 can be placed so that it is distanced (not immediately adjacent to) from the rolls of the second package.

A fifth package (not shown) may also be part of the array 10 and may comprise rolls having a Roll Diameter smaller than the second package 202, but larger than the first and third packages. In this way, the fifth package may comprise rolls having a Roll Diameter smaller than the largest Roll Diameter, but larger than the smallest Roll Diameter and larger than the next-to-smallest Roll Diameter. The Roll Diameter of the rolls of the fifth package may be larger or smaller than the Roll Diameter of the rolls of the fourth package 204. This fifth package offering may be placed on the opposite end of the array as the fourth package, such that the fourth package 204 and fifth package (not shown) each flank the array. In such an arrangement, the largest Roll Diameter rolls of the second package 202 are centered in the array 10, which may emphasize the largest diameter rolls as the premier rolls of the array, such that the most attention is given to them by the shopper.

Beyond being the premier rolls for the purchaser/user, the Larger Diameter Rolls, and the Packages containing them, are also the best rolls for the retailer selling them because the retailer may offer more paper per volume of shelf space because Larger Diameter Rolls utilize fewer hollow cores. For instance, Traditional Diameter Rolls of toilet paper may have total linear length values per roll of less than about 1590 inches, 1550 inches, 1500 inches, 1400 inches, 1300 inches, 1200 inches, 1000 inches, or 500 inches, and all 1 inch increments therebetween, while Larger Roll Diameter Rolls of toilet paper may have total linear length values per roll of greater than about 1600 inches, 1650 inches, 1700 inches, 1800 inches, 1900 inches, 2000 inches, 3000 inches, 4000 inches, 5000 inches, 6000 inches, 7000 inches, or 8000 inches, and all 1 inch increments therebetween. Likewise, Traditional Diameter Rolls of paper towels may have total linear length values per roll of less than about 700 inches, 650 inches, 600 inches, 550 inches, 500 inches, 400 inches, 300 inches, or 250 inches, and all 1 inch increments therebetween, while Larger Roll Diameter Rolls of paper towels may have total linear length values per roll of greater than about 725 inches, 750 inches, 800 inches, 900 inches, 1000 inches, 1100 inches, 1200 inches, 1300 inches, 1400 inches, 1500 inches, 2000 inches, or 3000 inches, and all 1 inch increments therebetween. These total linear length values for both toilet paper and paper towels make it evident that Larger Diameter Rolls and Packages will have more paper and fewer cores per volume of shelf space, which will result in more efficient shelf displays for the retailer—allowing for more paper to be sold in a given space of shelf area or will free up space to allow for additional products to be sold. In this way, the retailer's display space may be economized.

The dispositions of the first, second, third, fourth, and fifth packages above may be oriented from top to bottom (i.e., up and down as the stack of shelves is viewed by a shopper in an aisle or a shopper looking at a representation of the array on a computer) of the array (see FIG. 2C) or from left to right (i.e., side-to-side as the stack of shelves is viewed by a shopper in an aisle or a shopper looking at a representation of the array on a computer) of the array (see FIG. 2D). In FIG. 2D, the fourth package 204 is not shown, but may be disposed as a row at the very top of the array or at the very bottom of the array—and the fifth package (not shown) may be placed in an opposing row versus the fourth package, such that the fourth and fifth packages flank the first, second, and third packages, and such that the second packages are centered in the array. It may be desirable to dispose a plurality of second packages comprising Larger Diameter Rolls such that they are centered (up and down as in FIG. 2C or side-to-side as in FIG. 2D) between the other offerings of the array.

Referring to FIG. 3, packages 100 may have brand name indicia 300 that have an "Indicia Height" 210' and an "Indicia Width" 212', such that a brand indicia Surface Area is the two multiplied together. Normally, as the Surface Area front face of a package increases, so does the Surface Area of the brand indicia. However, contrary to popular expectations, it may be desirable to use the same size (same Surface Area) brand indicia 300 on the front face of the package comprising the largest (of the array) Larger Diameter Rolls (e.g., the second package 202) as on the next-to-largest (of the array) Traditional Diameter Rolls (e.g., the fourth package 204). For example, in FIG. 3, the Surface Area of the brand indicia 300 of the second package 202 is approximately the same as the Surface Area of the brand indicia 300 of the fourth package 204, even though the Surface Area of the front face of the second package 202 is larger than the Surface Area of the front face of the fourth package 204. One reason that it may not be desirable to increase the Surface Area of the brand or trademark to the same extent that the front face Surface Area of the larger diameter roll package increases versus the front face Surface Areas of the traditional diameter roll packages is that extra room may be used to communicate (via, for example, additional information identifiers 301-304) important information about the new formats, such as the larger diameter roll's scale and properties—without this information, a consumer cannot be expected know the appropriate use of the larger diameter roll (e.g., that the larger diameter roll is for residential use, that it is as soft or softer than traditionally sized rolls, that it is meant for the kitchen, that it can or cannot fit onto certain types of roll holders, that it is still the same height, its sheet equivalence versus traditionally sized rolls). For example, as a the package front face Surface Area comprising Larger Diameter Rolls increases by X % over a package front face Surface Area comprising Traditional Diameter Rolls, the brand indicia 300 Surface Area of the package comprising Larger Diameter Rolls may increase about X minus 5%, X minus 10%, or X minus 15% versus the brand indicia 300 Surface Area of the package comprising Traditional Diameter Rolls; or the brand indicia 300 Surface Area of the package comprising Larger Diameter Rolls may be the same or even less than the brand indicia 300 Surface Area of the package comprising Traditional Diameter Rolls. In this example of this paragraph, the Face-to-Brand Indicia Ratio (front face Surface Area divided by the brand indicia Surface Area) of the larger roll diameter package (e.g., 202) is larger than the Face-to-Brand Indicia Ratio of traditional diameter roll package (e.g., 204, 205). The Face-to-Brand Ratio of the package comprising Larger Diameter Rolls may be about 5%, 10%, 15%, 20%, 25%, or 30%, including all 0.1% increments therebetween, greater than the Face-to-Brand Ratio of packages comprising Traditional Diameter Rolls.

Figure 8A:
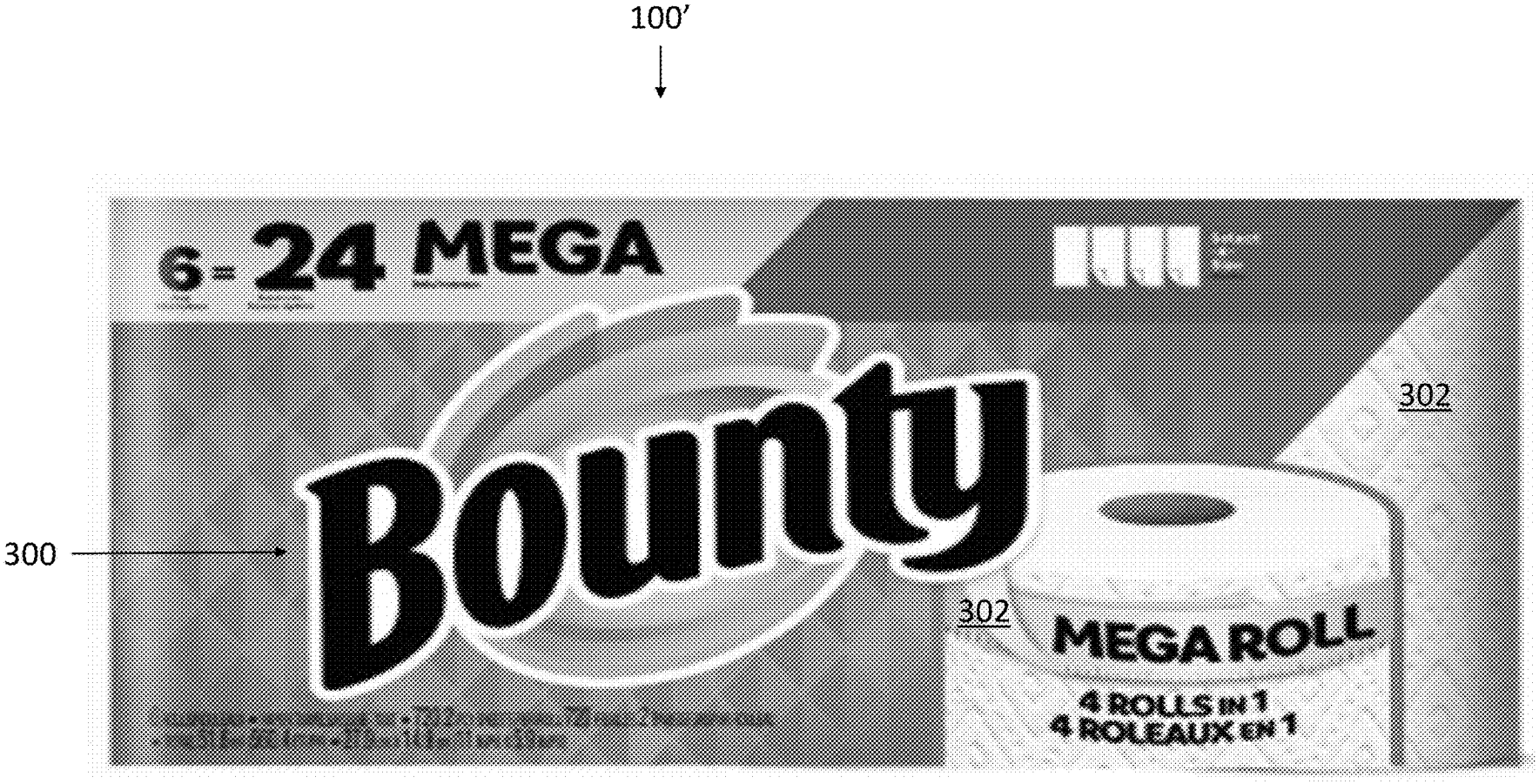
FIG. 8A is a front face view of a package of absorbent paper product.
Figure 8B:
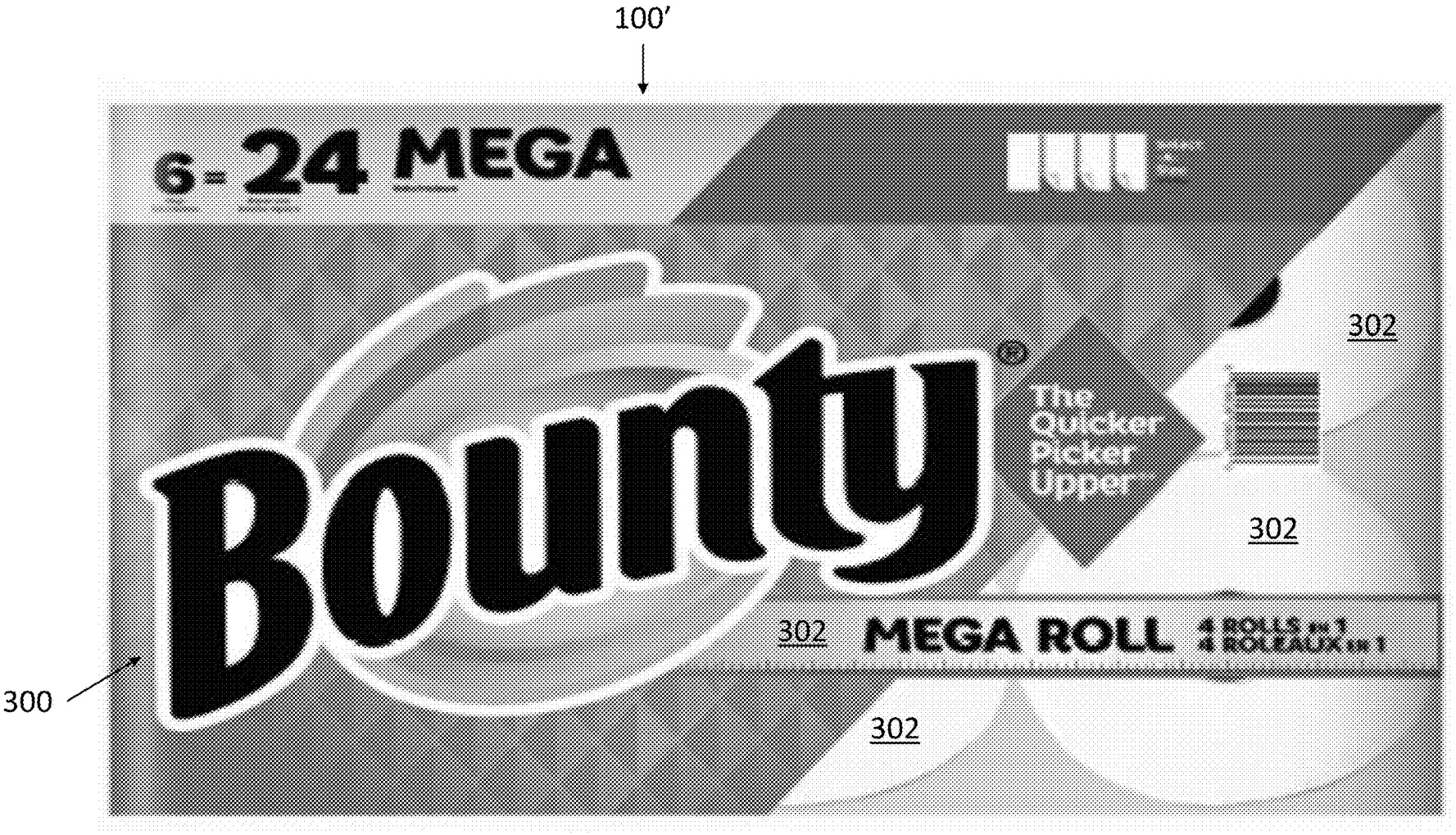
FIG. 8B is a top view of the package of FIG. 8A.

Beyond the brand identifiers 300, additional information identifiers, such as 301-304 in FIG. 3, may have an "Additional Information Identifier Height" 210" and an "Additional Information Identifier Width" 212", such that an additional identifier Surface Area is the two multiplied together. Continuing the disclosure from the paragraph above, the extra room that may be created on the package comprising Larger Diameter Rolls may be used for additional information identifiers (e.g., 302) having a greater Surface Area versus the additional information identifiers on the package(s) comprising Traditional Diameter Rolls. The larger additional information identifier may be a representation of a paper towel roll or a toilet paper roll that is larger than previous offerings. For instance, an illustration of a tape measure may wrap around the representation of a rolled product (see FIG. 8A). The representation of the rolled product of the additional information identifier may be the actual size (e.g., width and/or height) of the rolled product(s) within the package or may be within about 5%, 10%, 15%, or within 20%, including all 1% increments therebetween, of the width and/or height of the rolled product(s) within the package. For instance, the additional information identifier (e.g., 302) on the front face of the package may be of a side profile (or a portion thereof, see FIG. 8A) of the rolled products as they are oriented in the package; additionally or alternatively, an illustration of a top view profile (illustrating the rings of wound paper and the core, see FIG. 8B) of the rolled product may be on a top and/or bottom face of the package to more fully communicate the scale of the rolled product(s) in the package. This is important for rolled products that are much larger than rolls previously offered or for rolls that are newly part of an array, whereas they were previously only sold individually, outside of an array. One reason that such illustrations may be important is because substantially larger rolls may be a surprise to consumers as they may not fit traditional holders. Another reason such illustrations may be important is to communicate the potential value of the larger roll. It may also be desirable that Traditional Diameter Roll Packages do not illustrate rolls that are actual or approximate dimensions of the rolled product(s) inside the package since this message on packages of Traditional Diameter Rolls can confuse or dilute the messages of the value or newness of the scale of Larger Diameter Rolls illustrated on the Larger Diameter Roll Packages.

Each of the packages illustrated in FIGS. 2A-3 may have the same paper composition and/or the same belt design and/or the same emboss design and/or the same basis weight.

Referring to FIGS. 2A, C, D, and 3, the first, second, third, and fourth packages may have the same Package Height 210.

Each of the packages illustrated in FIGS. 2A-3 may be manufactured and/or marketed by the same company and each of the packages of FIGS. 2A-3 may have the same brand name; further each of the packages illustrated in FIGS. 2A-3 may have the same paper composition and/or the same belt design and/or the same emboss design and/or the same basis weight.

Alternatively, some of the packages illustrated in FIGS. 2A-3, while being manufactured and/or marketed by the same company and having the same brand identifier (e.g., 300), may have different paper composition and/or different belt design and/or different emboss design and/or different basis weight and/or different identifiers (e.g., 301-303) such that, for example, "soft" toilet paper is differentiated from "strong" toilet paper.

Referring to FIGS. 2A-3, the first plurality of disposable, fibrous, rolled product rolls 106*a* (Traditional Diameter Rolls) may have a first average Roll Firmness, and the second plurality of disposable, fibrous, rolled product rolls 106*a*' (Larger Diameter Rolls) may have a second average Roll Firmness, where the second average Roll Firmness is less (i.e., more firm) than the first average Roll Firmness.

Referring to FIG. 2A-3, the first plurality of disposable, fibrous, rolled products 106 (Traditional Diameter Rolls) may have a first Package Roll Firmness, and the second plurality of disposable, fibrous, rolled products 106' (Larger Diameter Rolls) may have a second Package Roll Firmness, where the second Package Roll Firmness is less (i.e., more firm) than the first Package Roll Firmness.

Referring to FIGS. 2A-3, the second plurality of disposable, fibrous, rolled product rolls 106*a*' (Larger Diameter Rolls) may have an Inner Roll Firmness and an Outer Roll Firmness, where the Inner Roll Firmness is less (i.e., more firm) than the Outer Roll Firmness.

Referring to FIGS. 2A-3, the first plurality of disposable, fibrous, rolled product rolls 106*a* (Traditional Diameter Rolls) may have a first average Total Dry Tensile Strength, and the second plurality of disposable, fibrous, rolled product rolls 106*a*' (Larger Diameter Rolls) may have a second average Total Dry Tensile Strength, where the second average Total Dry Tensile Strength is greater (i.e., more strong) than the first Total Dry Tensile Strength.

Referring to FIGS. 2A-3, the first plurality of disposable, fibrous, rolled product rolls 106*a* (Traditional Diameter Rolls) may have a first average Total Wet Tensile Strength, and the second plurality of disposable, fibrous, rolled product rolls 106*a*' (Larger Diameter Rolls) may have a second average Total Wet Tensile Strength, where the second average Total Wet Tensile Strength equal to or is less (i.e., less strong) than the first Total Wet Tensile Strength.

Referring to FIGS. 2A-3, the first and/or second pluralities of disposable, fibrous, rolled products 106 (Large and Traditional Diameter Rolls) may be 2-ply.

Referring to FIGS. 2A-3, as detailed above, the second package 202 (Larger Roll Package) may be placed between (left and right) the first 201 and third 203 packages—from a front view perspective of the shelf by the customer.

Referring to FIGS. 2A-3, the first package 201 (Traditional Roll Package) may comprise more rolls 106*a* than the second package 202 (Larger Roll Package). The second package may comprise 2 to 8, 3 to 6, or 4 Larger Diameter Rolls; and the second package may be 2 to 6 rolls deep, or may be 3-5 rolls deep, or may be 4 rolls deep; and the second package may be 1 to 6 rolls wide, or 2-5 rolls wide, or 3-4 rolls wide.

Referring to FIGS. 2A-3, the second package 202 (Large Diameter Package) may be heavier than the first package 201 (Traditional Roll Package). When the second package of Larger Diameter Rolls weighs more than the first package of smaller diameter rolls, this communicates that the second package is a greater value. This feature may be combined with a second package having a larger second front face as described above.

Referring to FIGS. 2A-3, the first plurality of disposable, fibrous, rolled product rolls 106*a* (Traditional Diameter Rolls) may have a first average Basis Weight, and the second plurality of disposable, fibrous, rolled product rolls 106*a*' (Larger Diameter Rolls) may have a second average Basis Weight, where the second average Basis Weight is greater than the first average Basis Weight.

Referring to FIGS. 2A-3, the first plurality of disposable, fibrous, rolled product rolls 106*a* (Traditional Diameter Rolls) may comprise a first average Roll Density, and the second plurality of disposable, fibrous, rolled product rolls (Larger Diameter Rolls) may comprise a second average Roll Density, where the first average Roll Density is less than the second average Roll Density.

Referring to FIGS. 2A-3, the first plurality of disposable, fibrous, rolled product rolls 106*a* (Traditional Diameter Rolls) may comprise a first average Lint value, and the second plurality of disposable, fibrous, rolled product rolls 106*a*' (Larger Diameter Rolls) may comprise a second average Lint value, where the second average Lint value is less than the first average Lint value.

Referring to FIGS. 2A-3, the first plurality of disposable, fibrous, rolled product rolls 106*a* (Traditional Diameter Rolls) may comprise a first average Softness value, and the second plurality of disposable, fibrous, rolled product rolls 106*a*' (Larger Diameter Rolls) may comprise a second average Softness value, where the second average Softness value is less than the first average Softness value.

Referring to FIGS. 1-4 and 7A and B, the disposable, fibrous, rolled product rolls 106*a* (Large and Traditional Diameter Rolls) may be textured and/or perforated.

Larger Roll Packages may also comprise extension hangers (attached to the package or contained within the package) so that the Larger Diameter Rolls may be used on the existing hardware used for Traditional Diameter Rolls.

Figure 7A:
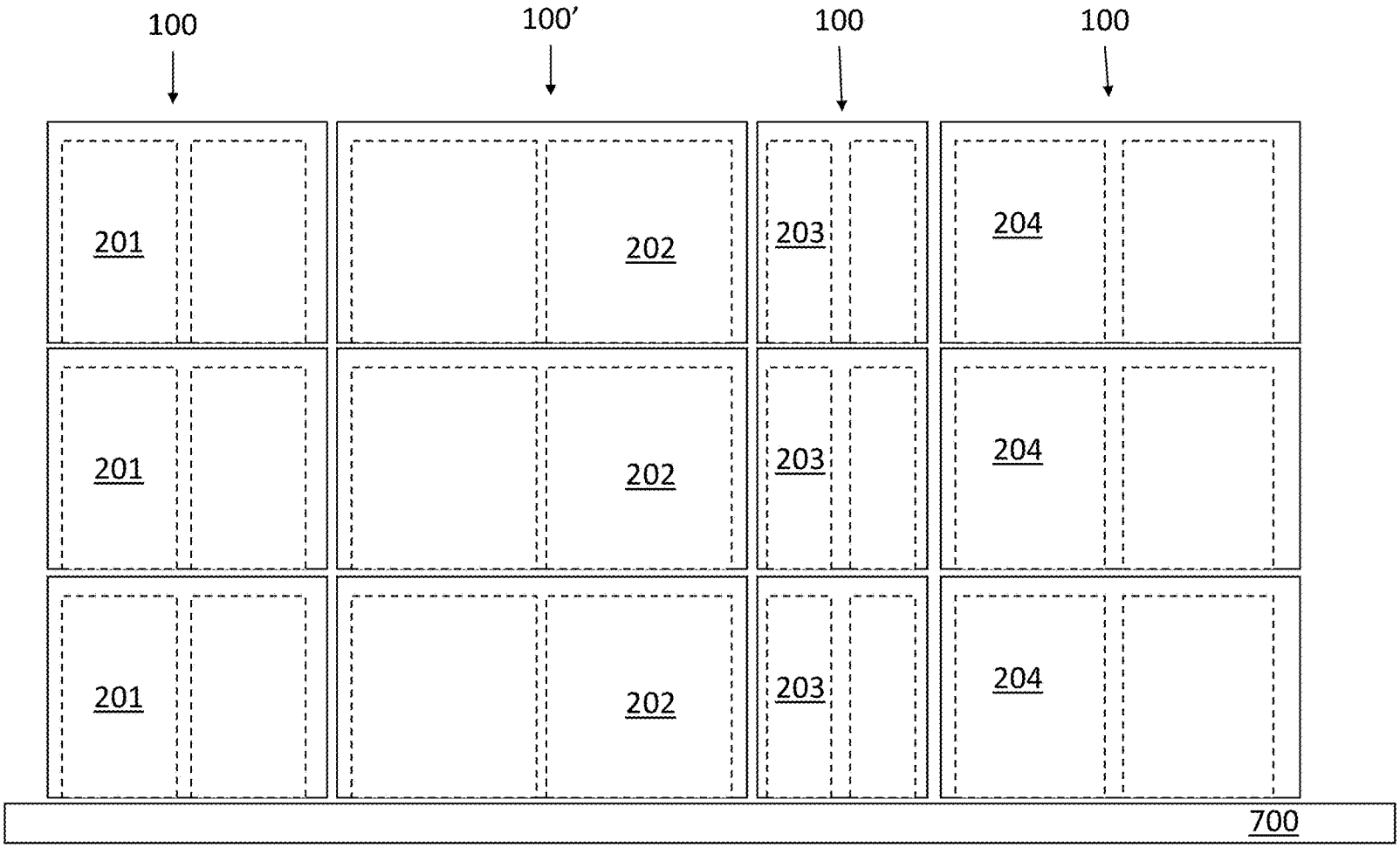
FIG. 7A is a pallet of Traditional Roll Packages and Larger Roll Packages.
Figure 7B:
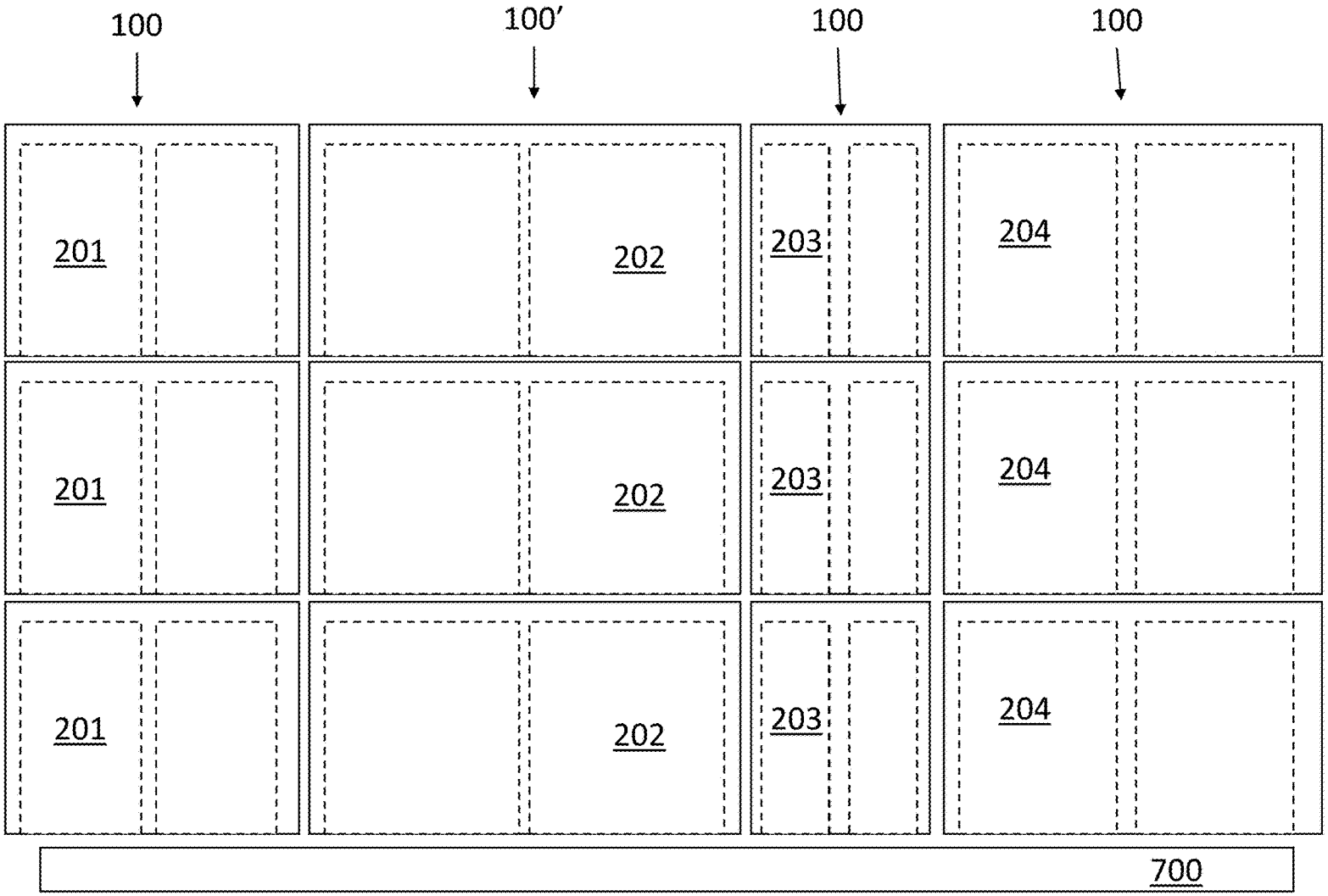
FIG. 7B is a pallet of Traditional Roll Packages and Larger Roll Packages.

FIGS. 7A and B illustrate an array of Larger Roll Packages 100' (e.g., 202) and Traditional Roll Packages 100 (e.g., 201, 203, and 204) on a pallet 700 to form a "Pallet Array." Pallet Arrays may be used for sending retail stores the necessary assortment of packages that includes Larger Roll Packages 100' so that inventive arrays such as the ones described and illustrated by FIGS. 2A-3 may be formed by the retailer. In some instances, due to the non-traditional size of the Larger Diameter Roll Packages, there may be a need to arrange the packages such that an underhung pallet is created (see FIG. 7A) or such that an overhung pallet is created (see FIG. 7B)—see also U.S. Ser. No. 16/811,444 or U.S. Pub. No. US2020/0283208A1, which further discloses over and underhung pallet arrangements.

Further, Pallet Arrays such as the ones illustrated by FIGS. 7A and B may be especially useful for being placed at the retailer in a locations where customers wanting to purchase such items may pick the package directly from the pallet 700. This eliminates the need for the retailer to unload the pallet to create an array on a shelf 200. Rather, the Pallet Array may be used in place of a shelf, providing the customers ready access to the Larger Roll Packages. The Pallet Arrays may be placed such that an aisle is formed between the Pallet Arrays.

Beyond the advantages described above, Larger Roll Packages can help retailers save space. For instance, shelf space or end of aisle displays can be economized by providing for denser product displays, which Larger Roll Packages accommodate as even Larger Diameter Rolls having the same paper type and the same Roll Firmness as Traditional Diameter Rolls, are denser per volume as they have more paper and fewer cores. So, by providing more paper per volume of display space, the retailer's display space is economized.

The various aspects of the arrays above using retail store shelves and/or pallets arranged in the retail setting may be realized on-line. The same inventive arrangements above may be presented as imagery on a screen (e.g., phone or computer screens). In this way on-line arrays utilizing the teachings above may be exercised. For example:

A digital array may comprise first and second representations displayable on a screen (e.g., computer monitor, a phone or tablet screen, etc.) of first and second packages, respectively. The first and second representations may comprise first and second front faces, respectively and each may be disposed as screen-facing. The first and second packages may be represented as comprising first and second pluralities of disposable, fibrous, rolled products, respectively. The first plurality of disposable, fibrous, rolled products associated with the first package may have a first average Roll Diameter of 6.6 inches or less for paper towels, a first average Roll Diameter of 5.85 inches or less for toilet paper, a first total linear length value per roll of less than about 700 inches for paper towels, or a first total linear length value per roll of less than about 1590 inches for toilet paper. The second plurality of disposable, fibrous, rolled products associated with the second package may have a second average Roll Diameter of 6.7 inches or greater for paper towels, a second average Roll Diameter of 5.9 inches or greater for toilet paper, a second total linear length value per roll of greater than about 725 inches for paper towels, or a second total linear length value per roll of greater than about 1600 inches for toilet paper. The second front face may have a larger on-screen Surface Area than the first front face. The first and second front faces may be displayed or capable of being displayed on a same screen of the digital array and the first and second packages displayed may comprise the same brand name Aspects of the Present Disclosure The following aspects of the disclosure are exemplary only and not intended to limit the scope of the disclosure:

Aspect 1:

1. A retail store shelf array of disposable, fibrous, rolled products, comprising:
   - a first package comprising a first front face disposed as aisle facing, the first package comprising a first plurality of disposable, fibrous, rolled products, the first plurality of disposable, fibrous, rolled products comprising a first average Roll Diameter of 5.85 inches or less;
   - a second package comprising a second front face disposed as aisle facing, the second package comprising a second plurality of disposable, fibrous, rolled products, the second plurality of disposable, fibrous, rolled products comprising a second average Roll Diameter of 5.9 inches or greater;

a third package comprising a third front face disposed as aisle facing, the third package comprising a third plurality of disposable, fibrous, rolled products, the third plurality of disposable, fibrous, rolled products comprising a third average Roll Diameter of 5.85 inches or less;

wherein the second package is disposed between the first and third packages, such that the disposable, fibrous, rolled products comprising an average Roll Diameter of 5.85 inches or less flank the disposable, fibrous, rolled products comprising an average Roll Diameter of 5.9 inches or greater;

wherein the second front face has a larger Surface Area than the first and third front faces;

wherein the first, second, and third packages comprise the same brand name.

2. The array of claim 1, wherein the rolled products of the third package have a smaller average Roll Diameter than the rolled products of the first package.
3. The array of claim 2, wherein the third package is disposed immediately adjacent to the second package.
4. The array of claim 3, wherein the first package is disposed immediately adjacent to the second package.
5. The array of claim 1, wherein a plurality of second packages are arranged up and down or side-to-side.
6. The array of claim 5, wherein the plurality of second packages are centered between other packages making up the array.
7. The array of claim 6, wherein the plurality of second packages are centered up and down.
8. The array of claim 6, wherein the plurality of second packages are centered side-to-side.
9. The array of claim 1, further comprising a fourth package comprising a fourth front face disposed as aisle facing, the fourth package comprising a fourth plurality of disposable, fibrous, rolled products, the fourth plurality of disposable, fibrous, rolled products comprising a fourth average Roll Diameter of 5.85 inches or less.
10. The array of claim 9, wherein the rolled products of the fourth package have a larger average Roll Diameter than the rolled products of the first and third packages.
11. The array of claim 10, wherein the fourth package is not disposed immediately adjacent to the second package.
12. The array of claim 11, further comprising a fifth package comprising a fifth front face disposed as aisle facing, the fifth package comprising a fifth plurality of disposable, fibrous, rolled products, the fifth plurality of disposable, fibrous, rolled products comprising a fifth average Roll Diameter of 5.85 inches or less.
13. The array of claim 12, wherein the rolled products of the fifth package have a greater average Roll Diameter than the rolled products of the first, third, and fourth packages.
14. The array of claim 13, wherein the fifth package is not disposed immediately adjacent to the second package.
15. The array of claim 14, wherein the fifth package is disposed opposite of the fourth package such that the fourth and fifth packages flank the array.
16. The array of claim 15, wherein the fourth and fifth packages flank the array along a top and a bottom, respectively, or wherein the fourth and fifth packages flank the array along the bottom and the top, respectively.
17. The array of claim 15, wherein the fourth and fifth packages flank the array along sides of the array.
18. The array of claim 12, wherein the first, second, third, fourth, and fifth front faces each comprise first, second, third, fourth, and fifth brand indicia, respectively, and wherein each of the first, second, third, fourth, and fifth front faces each comprise a first, second, third, fourth, and fifth Face-to-Brand Indicia Ratio, respectively, wherein the second Face-to-Brand Indicia Ratio is greater than the Face-to-Brand Indicia Ratio of the fourth front face.
19. The array of claim 12, wherein the first, second, third, fourth, and fifth front faces each comprise first, second, third, fourth, and fifth brand indicia, respectively, and wherein each of the first, second, third, fourth, and fifth front faces each comprise a first, second, third, fourth, and fifth Face-to-Brand Indicia Ratio, respectively, wherein the second Face-to-Brand Indicia Ratio is greater than the Face-to-Brand Indicia Ratio of the fifth front face.
20. The array of claim 12, wherein the first, second, third, fourth, and fifth front faces each comprise first, second, third, fourth, and fifth brand indicia, respectively, and wherein each of the first, second, third, fourth, and fifth front faces each comprise a first, second, third, fourth, and fifth Face-to-Brand Indicia Ratio, respectively, wherein the second Face-to-Brand Indicia Ratio is greater than the Face-to-Brand Indicia Ratio of at least one of the fourth and fifth front faces.
21. The array of claim 12, wherein each of the second, fourth, and fifth front faces each comprise second, fourth, and fifth additional information indicia, respectively, and wherein each of the second, fourth, and fifth additional information indicia have a Surface Area, wherein the Surface Area of the second additional information indicia on the second front face is greater than at least one of the fourth and fifth Surface Areas of the fourth and fifth additional information indicia on the fourth and fifth front faces.
22. The array of claim 1, wherein each of the packages of the array have the same color pallet and design architecture.

Aspect 2:

A digital array, comprising:

a first representation of a first package comprising a first front face disposed as screen-facing, the first package represented as comprising a first plurality of disposable, fibrous, rolled products, wherein the first plurality of disposable, fibrous, rolled products associated with the first package have a first average Roll Diameter of 6.6 inches or less;

a second representation of a second package comprising a second front face disposed as screen-facing, the second package represented as comprising a second plurality of disposable, fibrous, rolled products, wherein the second plurality of disposable, fibrous, rolled products associated with the second package have a second average Roll Diameter of 6.7 inches or greater;

wherein the second front face has a larger on-screen Surface Area than the first front face;

wherein the first and second front faces are displayed or capable of being displayed on a same screen of the digital array; and wherein the first and second packages comprise the same brand name Aspect 3:

A digital array, comprising:

a first representation of a first package comprising a first front face disposed as screen-facing, the first package represented as comprising a first plurality of disposable, fibrous, rolled products, wherein the first plurality of disposable, fibrous, rolled products associated with the first package have a first average Roll Diameter of 5.85 inches or less;

a second representation of a second package comprising a second front face disposed as screen-facing, the second package represented as comprising a second plurality of disposable, fibrous, rolled products, wherein the second plurality of disposable, fibrous, rolled products associated with the second package have a second average Roll Diameter of 5.9 inches or greater;

wherein the second front face has a larger on-screen Surface Area than the first front face;

wherein the first and second front faces are displayed or capable of being displayed on a same screen of the digital array; and wherein the first and second packages comprise the same brand name Aspect 4:

1. A retail store shelf array of disposable, fibrous, rolled products, comprising:

a first package comprising a first front face disposed as aisle facing, the first package comprising a first plurality of disposable, fibrous, rolled products, the first plurality of disposable, fibrous, rolled products comprising a first average Roll Diameter of 6.6 inches or less;

wherein the first front face comprises a first front face Surface Area and a first brand indicia comprising a first brand indicia Surface Area, and wherein the first front face of the first package has a first Face-to-Brand Indicia Ratio;

a second package comprising a second front face disposed as aisle facing, the second package comprising a second plurality of disposable, fibrous, rolled products, the second plurality of disposable, fibrous, rolled products comprising a second average Roll Diameter of 6.7 inches or greater;

wherein the second front face comprises a second front face Surface Area and a second brand indicia comprising a second brand indicia Surface Area, and wherein the second front face of the second package has a second Face-to-Brand Indicia Ratio;

wherein the second Face-to-Brand Indicia is greater than the first Face-to-Brand Indicia.

2. The array of claim 1, wherein the first and second brand indicia Surface Areas are about the same.

3. The array of claim 1, wherein the second brand indicia Surface Area is greater than the first brand indicia Surface Area.

4. The array of claim 1, wherein the second brand indicia Surface Area is less than the first brand indicia Surface Area.

5. The array of claim 1, wherein the second front face Surface Area is larger than the first front face Surface Area.

6. The array of claim 1, wherein the second front face Surface Area is at least about 5% larger than the first front face Surface Area.

7. The array of claim 1, wherein the second front face Surface Area is at least about 10% larger than the first front face Surface Area.

8. The array of claim 1, wherein the second front face Surface Area is at least about 15% larger than the first front face Surface Area.

9. The array of claim 1, wherein the second front face Surface Area is at least about 20% larger than the first front face Surface Area.

10. The array of claim 1, wherein the second front face Surface Area is at least about 30% larger than the first front face Surface Area.

Aspect 5:

1. A retail store shelf array of disposable, fibrous, rolled products, comprising:

a first package comprising a first front face disposed as aisle facing, the first package comprising a first plurality of disposable, fibrous, rolled products, the first plurality of disposable, fibrous, rolled products comprising a first average Roll Diameter of 6.6 inches or less, the first package also comprising a first top face disposed approximately 90 degrees from the first front face and defining the top of the first package;

wherein the first front face does not comprise a first side representation of at least a portion of a side profile of a disposable, fibrous, rolled product, and wherein the first top face does not comprise a first top representation of at least a portion of a top profile of a disposable, fibrous, rolled product;

a second package comprising a second front face disposed as aisle facing, the second package comprising a second plurality of disposable, fibrous, rolled products, the second plurality of disposable, fibrous, rolled products comprising a second average Roll Diameter of 6.7 inches or greater, the second package also comprising a second top face disposed approximately 90 degrees from the second front face and defining the top of the second package;

wherein the second front face comprises a second side representation of at least a portion of a side profile of a disposable, fibrous, rolled product, and wherein the second top face comprises a second top representation of at least a portion of a top profile of a disposable, fibrous, rolled product.

2. The array of claim 1, wherein the second side representation is about the same scale as at least one side profile of at least one roll of the second plurality of disposable, fibrous, rolled products.

3. The array of claim 1, wherein the second top representation is about the same scale as at least one top profile of at least one roll of the second plurality of disposable, fibrous, rolled products.

4. The array of claim 1, wherein the second side representation is within about 15% of a width of at least one side profile of at least one roll of the second plurality of disposable, fibrous, rolled products.

5. The array of claim 1, wherein the second side representation is within about 10% of a width of at least one side profile of at least one roll of the second plurality of disposable, fibrous, rolled products.

6. The array of claim 1, wherein the second side representation is within about 5% of a width of at least one side profile of at least one roll of the second plurality of disposable, fibrous, rolled products.

7. The array of claim 1, wherein the second side representation is within about 15% of a width of at least one top profile of at least one roll of the second plurality of disposable, fibrous, rolled products.

8. The array of claim 1, wherein the second side representation is within about 10% of a width of at least one top profile of at least one roll of the second plurality of disposable, fibrous, rolled products.
9. The array of claim 1, wherein the second side representation is within about 5% of a width of at least one top profile of at least one roll of the second plurality of disposable, fibrous, rolled products.
10. The array of claim 1, wherein the first front face comprises a first brand indicia and the second front face comprises a second brand indicia, wherein the first and second brand indicia are the same brand.
11. The array of claim 1, wherein the first front face comprises an additional information indicia and the second front face comprises a second additional information indicia, wherein the first and second additional information indicia illustrate different information.

Aspect 6:

1. A retail store shelf array of disposable, fibrous, rolled products, comprising:
   a first package comprising a first front face disposed as aisle facing, the first package comprising a first plurality of disposable, fibrous, rolled products, the first plurality of disposable, fibrous, rolled products having a first total linear length value per roll of less than about 700 inches;
   a second package comprising a second front face disposed as aisle facing, the second package comprising a second plurality of disposable, fibrous, rolled products, the second plurality of disposable, fibrous, rolled products having a second total linear length value per roll of greater than about 725 inches;
   a third package comprising a third front face disposed as aisle facing, the third package comprising a third plurality of disposable, fibrous, rolled products, the third plurality of disposable, fibrous, rolled products having a third total linear length value per roll of less than about 700 inches;
   wherein the second package is disposed between the first and third packages, such that the disposable, fibrous, rolled products having a total linear length value per roll of less than about 700 inches flank the disposable, fibrous, rolled products having a total linear length value per roll of greater than about 725 inches;
   wherein the second front face has a larger Surface Area than the first and third front faces;
   wherein the first, second, and third packages comprise the same brand name.
2. The array of claim 1, wherein the rolled products of the third package have a smaller average Roll Diameter than the rolled products of the first package.
3. The array of claim 2, wherein the third package is disposed immediately adjacent to the second package.
4. The array of claim 3, wherein the first package is disposed immediately adjacent to the second package.
5. The array of claim 1, wherein a plurality of second packages are arranged up and down or side-to-side.
6. The array of claim 5, wherein the plurality of second packages are centered between other packages making up the array.
7. The array of claim 6, wherein the plurality of second packages are centered up and down.
8. The array of claim 6, wherein the plurality of second packages are centered side-to-side.
9. The array of claim 1, further comprising a fourth package comprising a fourth front face disposed as aisle facing, the fourth package comprising a fourth plurality of disposable, fibrous, rolled products, the fourth plurality of disposable, fibrous, rolled products having a fourth total linear length value per roll of less than about 700 inches;
10. The array of claim 9, wherein the rolled products of the fourth package have a larger average Roll Diameter than the rolled products of the first and third packages.
11. The array of claim 10, wherein the fourth package is not disposed immediately adjacent to the second package.
12. The array of claim 11, further comprising a fifth package comprising a fifth front face disposed as aisle facing, the fifth package comprising a fifth plurality of disposable, fibrous, rolled products, the fifth plurality of disposable, fibrous, rolled products having a fifth total linear length value per roll of less than about 700 inches;
13. The array of claim 12, wherein the rolled products of the fifth package have a greater average Roll Diameter than the rolled products of the first, third, and fourth packages.
14. The array of claim 13, wherein the fifth package is not disposed immediately adjacent to the second package.
15. The array of claim 14, wherein the fifth package is disposed opposite of the fourth package such that the fourth and fifth packages flank the array.
16. The array of claim 15, wherein the fourth and fifth packages flank the array along a top and a bottom, respectively, or wherein the fourth and fifth packages flank the array along the bottom and the top, respectively.
17. The array of claim 15, wherein the fourth and fifth packages flank the array along sides of the array.
18. The array of claim 12, wherein the first, second, third, fourth, and fifth front faces each comprise first, second, third, fourth, and fifth brand indicia, respectively, and wherein each of the first, second, third, fourth, and fifth front faces each comprise a first, second, third, fourth, and fifth Face-to-Brand Indicia Ratio, respectively, wherein the second Face-to-Brand Indicia Ratio is greater than the Face-to-Brand Indicia Ratio of the fourth front face.
19. The array of claim 12, wherein the first, second, third, fourth, and fifth front faces each comprise first, second, third, fourth, and fifth brand indicia, respectively, and wherein each of the first, second, third, fourth, and fifth front faces each comprise a first, second, third, fourth, and fifth Face-to-Brand Indicia Ratio, respectively, wherein the second Face-to-Brand Indicia Ratio is greater than the Face-to-Brand Indicia Ratio of the fifth front face.
20. The array of claim 12, wherein the first, second, third, fourth, and fifth front faces each comprise first, second, third, fourth, and fifth brand indicia, respectively, and wherein each of the first, second, third, fourth, and fifth front faces each comprise a first, second, third, fourth, and fifth Face-to-Brand Indicia Ratio, respectively, wherein the second Face-to-Brand Indicia Ratio is greater than the Face-to-Brand Indicia Ratio of at least one of the fourth and fifth front faces.
21. The array of claim 12, wherein each of the second, fourth, and fifth front faces each comprise second, fourth, and fifth additional information indicia, respectively, and wherein each of the second, fourth, and fifth additional information indicia have a Surface Area, wherein the Surface Area of the second additional information indicia on the second front face is greater than at least one of the fourth and fifth Surface Areas of the fourth and fifth additional information indicia on the fourth and fifth front faces.

22. The array of claim 1, wherein each of the packages of the array have the same color pallet and design architecture.

Aspect 7:

1. A retail store shelf array of disposable, fibrous, rolled products, comprising:
   a first package comprising a first front face disposed as aisle facing, the first package comprising a first plurality of disposable, fibrous, rolled products, the first plurality of disposable, fibrous, rolled products having a first total linear length value per roll of less than about 1590 inches;
   a second package comprising a second front face disposed as aisle facing, the second package comprising a second plurality of disposable, fibrous, rolled products, the second plurality of disposable, fibrous, rolled products having a second total linear length value per roll of greater than about 1600 inches;
   a third package comprising a third front face disposed as aisle facing, the third package comprising a third plurality of disposable, fibrous, rolled products, the third plurality of disposable, fibrous, rolled products having a third total linear length value per roll of less than about 1590 inches;
   wherein the second package is disposed between the first and third packages, such that the disposable, fibrous, rolled products having a total linear length value per roll of less than about 1590 inches flank the disposable, fibrous, rolled products having a total linear length value per roll of greater than about 1600 inches;
   wherein the second front face has a larger Surface Area than the first and third front faces;
   wherein the first, second, and third packages comprise the same brand name.
2. The array of claim 1, wherein the rolled products of the third package have a smaller average Roll Diameter than the rolled products of the first package.
3. The array of claim 2, wherein the third package is disposed immediately adjacent to the second package.
4. The array of claim 3, wherein the first package is disposed immediately adjacent to the second package.
5. The array of claim 1, wherein a plurality of second packages are arranged up and down or side-to-side.
6. The array of claim 5, wherein the plurality of second packages are centered between other packages making up the array.
7. The array of claim 6, wherein the plurality of second packages are centered up and down.
8. The array of claim 6, wherein the plurality of second packages are centered side-to-side.
9. The array of claim 1, further comprising a fourth package comprising a fourth front face disposed as aisle facing, the fourth package comprising a fourth plurality of disposable, fibrous, rolled products, the fourth plurality of disposable, fibrous, rolled products having a fourth total linear length value per roll of less than about 1590 inches;
10. The array of claim 9, wherein the rolled products of the fourth package have a larger average Roll Diameter than the rolled products of the first and third packages.
11. The array of claim 10, wherein the fourth package is not disposed immediately adjacent to the second package.
12. The array of claim 11, further comprising a fifth package comprising a fifth front face disposed as aisle facing, the fifth package comprising a fifth plurality of disposable, fibrous, rolled products, the fifth plurality of disposable, fibrous, rolled products having a fifth total linear length value per roll of less than about 1590 inches;
13. The array of claim 12, wherein the rolled products of the fifth package have a greater average Roll Diameter than the rolled products of the first, third, and fourth packages.
14. The array of claim 13, wherein the fifth package is not disposed immediately adjacent to the second package.
15. The array of claim 14, wherein the fifth package is disposed opposite of the fourth package such that the fourth and fifth packages flank the array.
16. The array of claim 15, wherein the fourth and fifth packages flank the array along a top and a bottom, respectively, or wherein the fourth and fifth packages flank the array along the bottom and the top, respectively.
17. The array of claim 15, wherein the fourth and fifth packages flank the array along sides of the array.
18. The array of claim 12, wherein the first, second, third, fourth, and fifth front faces each comprise first, second, third, fourth, and fifth brand indicia, respectively, and wherein each of the first, second, third, fourth, and fifth front faces each comprise a first, second, third, fourth, and fifth Face-to-Brand Indicia Ratio, respectively, wherein the second Face-to-Brand Indicia Ratio is greater than the Face-to-Brand Indicia Ratio of the fourth front face.
19. The array of claim 12, wherein the first, second, third, fourth, and fifth front faces each comprise first, second, third, fourth, and fifth brand indicia, respectively, and wherein each of the first, second, third, fourth, and fifth front faces each comprise a first, second, third, fourth, and fifth Face-to-Brand Indicia Ratio, respectively, wherein the second Face-to-Brand Indicia Ratio is greater than the Face-to-Brand Indicia Ratio of the fifth front face.
20. The array of claim 12, wherein the first, second, third, fourth, and fifth front faces each comprise first, second, third, fourth, and fifth brand indicia, respectively, and wherein each of the first, second, third, fourth, and fifth front faces each comprise a first, second, third, fourth, and fifth Face-to-Brand Indicia Ratio, respectively, wherein the second Face-to-Brand Indicia Ratio is greater than the Face-to-Brand Indicia Ratio of at least one of the fourth and fifth front faces.
21. The array of claim 12, wherein each of the second, fourth, and fifth front faces each comprise second, fourth, and fifth additional information indicia, respectively, and wherein each of the second, fourth, and fifth additional information indicia have a Surface Area, wherein the Surface Area of the second additional information indicia on the second front face is greater than at least one of the fourth and fifth Surface Areas of the fourth and fifth additional information indicia on the fourth and fifth front faces.

22. The array of claim 1, wherein each of the packages of the array have the same color pallet and design architecture.

Test Methods

If the method does not define a number of replicates to test, the "average" of each of the below described parameters for a roll is achieved by testing each roll within a most-outer package on a retail shelf and taking the average value.

Unless otherwise indicated, all tests described herein including those described under the Definitions section and the following test methods are conducted on samples, fibrous structure samples and/or sanitary tissue product samples and/or handsheets that have been conditioned in a conditioned room at a temperature of 73° F.±4° F. (about 23° C.±2.2° C.) and a relative humidity of 50%±10% for 2 hours prior to the test. Further, all tests are conducted in such conditioned room. Tested samples and felts should be subjected to 73° F.±4° F. (about 23° C.±2.2° C.) and a relative humidity of 50%±10% for 2 hours prior to testing.

"Basis Weight" Method:

Basis Weight is measured by preparing one or more samples of a certain area ($m^2$) and weighing the sample(s) of a fibrous structure according to the present invention and/or a sanitary toilet tissue product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$). The basis weight ($g/m^2$) is calculated by dividing the average weight (g) by the average area of the samples ($m^2$).

"Total Dry Tensile Strength" Test Method:

One (1) inch by five (5) inch (2.5 cm×12.7 cm) strips of fibrous structure and/or sanitary toilet tissue product are provided. The strip is placed on an electronic tensile tester Model 1122 commercially available from Instron Corp., Canton, Massachusetts in a conditioned room at a temperature of 73° F.±4° F. (about 28° C.±2.2° C.) and a relative humidity of 50%±10%. The crosshead speed of the tensile tester is 2.0 inches per minute (about 5.1 cm/minute) and the gauge length is 4.0 inches (about 10.2 cm). The Dry Tensile Strength can be measured in any direction by this method. The "Total Dry Tensile Strength" or "TDT" is the special case determined by the arithmetic total of MD and CD tensile strengths of the strips and the output is the peak load.

"Total Wet Tensile Strength" Test Method:

An electronic tensile tester (Thwing-Albert EJA Materials Tester, Thwing-Albert Instrument Co., 10960 Dutton Rd., Philadelphia, Pa., 19154) is used and operated at a crosshead speed of 4.0 inch (about 10.16 cm) per minute and a gauge length of 1.0 inch (about 2.54 cm), using a strip of a fibrous structure and/or sanitary tissue product of 1 inch wide and a length greater than 3 inches long. The two ends of the strip are placed in the upper jaws of the machine, and the center of the strip is placed around a stainless steel peg (0.5 cm in diameter). After verifying that the strip is bent evenly around the steel peg, the strip is soaked in distilled water at about 20° C. for a soak time of 5 seconds before initiating cross-head movement. The initial result of the test is an array of data in the form load (grams force) versus crosshead displacement (centimeters from starting point).

The sample is tested in two orientations, referred to here as MD (machine direction, i.e., in the same direction as the continuously wound reel and forming fabric) and CD (cross-machine direction, i.e., 90° from MD). The MD and CD wet tensile strengths are determined using the above equipment and the "Total Wet Tensile Strength" or "TWT" is determined by taking the sum of these two values and the output is the peak load.

"Softness" Test Method:

Ideally, prior to softness testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48% to 52% and within a temperature range of 22° C. to 24° C. Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;
2. a grade of plus two is given if X is judged to surely be a little softer than Y, and a grade of minus two is given if Y is judged to surely be a little softer than X;
3. a grade of plus three is given to X if it is judged to be a lot softer than Y, and a grade of minus three is given if Y is judged to be a lot softer than X; and, lastly:
4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

Lint Value Test Method:

The amount of lint generated from a finished fibrous structure is determined with a Sutherland Rub Tester (available from Danilee Co., Medina, Ohio) and a color spectrophotometer (a suitable instrument is the HunterLab LabScan XE, as available from Hunter Associates Laboratory Inc., Reston, VA, or equivalent). such as the Hunter LabScan XE. The rub tester is a motor-driven instrument for moving a weighted felt test strip over a finished fibrous structure specimen (referred to throughout this method as the "web") along an arc path. The Hunter Color L value is measured on the felt test strip before and after the rub test. The difference between these two Hunter Color L values is then used to calculate a lint value. This lint method is designed to be used with white or substantially white fibrous structures and/or sanitary toilet tissue products. Therefore, if testing of a non-white tissue, such as blue-colored or peach-colored tissue is desired, the same formulation should be used to make a sample without the colored dye, pigment, etc., using bleached kraft pulps.

i. Sample Preparation

Prior to the lint rub testing, the samples to be tested should be conditioned according to Tappi Method T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48 to 52% and within a temperature range of 22° C. to 24° C. This rub testing should also take place within the confines of the constant temperature and humidity room.

The web is first prepared by removing and discarding any product which might have been abraded in handling, e.g., on the outside of the roll. For products formed from multiple plies of webs, this test can be used to make a lint measurement on the multi-ply product, or, if the plies can be separated without damaging the specimen, a measurement can be taken on the individual plies making up the product. If a given sample differs from surface to surface, it is necessary to test both surfaces and average the values in order to arrive at a composite lint value. In some cases, products are made from multiple-plies of webs such that the facing-out surfaces are identical, in which case it is only necessary to test one surface. If both surfaces are to be tested, it is necessary to obtain six specimens for testing (Single surface testing only requires three specimens). Each specimen should measure approximately 9.5 by 4.5 in. (241.3 mm by 114 mm) with the 9.5 in. (241.3 mm) dimension running in the machine direction (MD). Specimens can be obtained directly from a finished product roll, if the appropriate width, or cut to size using a paper cutter. Each specimen should be folded in half such that the crease is running along the cross direction (CD) of the web sample. For two-surface testing, make up 3 samples with a first surface "out" and 3 with the second-side surface "out". Keep track of which samples are first surface "out" and which are second surface out.

Obtain a 30 in. by 40 in. piece of Crescent #300 cardboard. Using a paper cutter, cut out six pieces of cardboard to dimensions of 2.5 in. by 6 in. Puncture two holes into each of the six cards by forcing the cardboard onto the hold down pins of the Sutherland Rub tester.

Center and carefully place each of the 2.5 in. by 6 in. cardboard pieces on top of the six previously folded samples. Make sure the 6 in. dimension of the cardboard is running parallel to the machine direction (MD) of each of the tissue samples. Center and carefully place each of the cardboard pieces on top of the three previously folded samples. Once again, make sure the 6 in. dimension of the cardboard is running parallel to the machine direction (MD) of each of the web samples.

Fold one edge of the exposed portion of the web specimen onto the back of the cardboard. Secure this edge to the cardboard with adhesive tape obtained from 3M Inc. (¾ in. wide Scotch Brand, St. Paul, Minn.). Carefully grasp the other over-hanging tissue edge and snugly fold it over onto the back of the cardboard. While maintaining a snug fit of the web specimen onto the board, tape this second edge to the back of the cardboard. Repeat this procedure for each sample.

Turn over each sample and tape the cross-direction edge of the web specimen to the cardboard. One half of the adhesive tape should contact the web specimen while the other half is adhering to the cardboard. Repeat this procedure for each of the samples. If the tissue sample breaks, tears, or becomes frayed at any time during the course of this sample preparation procedure, discard and make up a new sample with a new tissue sample strip.

There will now be 3 first-side surface "out" samples on cardboard and (optionally) 3 second-side surface "out" samples on cardboard.

ii. Felt Preparation

Obtain a 30 in. by 40 in. piece of Crescent #300 cardboard. Using a paper cutter, cut out six pieces of cardboard to dimensions of 2.25 in. by 7.25 in. Draw two lines parallel to the short dimension and down 1.125 in. from the top and bottom most edges on the white side of the cardboard. Carefully score the length of the line with a razor blade using a straight edge as a guide. Score it to a depth about halfway through the thickness of the sheet. This scoring allows the cardboard/felt combination to fit tightly around and rest flat against the weight of the Sutherland Rub tester. Draw an arrow running parallel to the long dimension of the cardboard on this scored side of the cardboard.

Cut six pieces of black felt (F-55, or equivalent) to the dimensions of 2.25 in. by 8.5 in. Place a felt piece on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snugly fold over both overhanging felt edges onto the backside of the cardboard and attach with Scotch brand tape. Prepare a total of six of these felt/cardboard combinations. For best reproducibility, all samples should be run with the same lot of felt.

iii. Care of 4-Pound Weight

The four-pound weight has four square inches of effective contact area providing a contact pressure of one pound per square inch. Since the contact pressure can be changed by alteration of the rubber pads mounted on the face of the weight, it is important to use only the rubber pads supplied by the instrument manufacturer and mounted according to their instructions. These pads must be replaced if they become hard, abraded, or chipped off. When not in use, the weight must be positioned such that the pads are not supporting the full weight of the weight. It is best to store the weight on its side.

iv. Rub Tester Instrument Calibration

Set up and calibrate the Sutherland Rub Tester according to the manufacturer's instructions. For this method, the tester is preset to run for five strokes (one stroke is a full forward and reverse cycle of the movable arm) and operates at 42 cycles per minute.

v. Color Spectrophotometer Calibration

Setup and standardize the color instrument using a 2 in. measurement area port size utilizing the manufacturer supplied black tile, then white tile. Calibrate the instrument according to manufacturer's specifications using their supplied standard tiles and configure it to measure Hunter L, a, b values.

vi. Measurement of Samples

The first step in the measurement of lint is to measure the Hunter color values of the black felt/cardboard samples prior to being rubbed on the web sample. Center a felt covered cardboard, with the arrow pointing to the back of the color meter, over the measurement port backing it with a standard white plate. Since the felt width is only slightly larger than the viewing area diameter, make sure the felt completely covers the measurement area. After confirming complete coverage, take a reading and record the Hunter L value.

Measure the Hunter Color L values for all the felt covered cardboards using this technique. If the Hunter Color L values are all within 0.3 units of one another, take the average to obtain the initial L reading. If the Hunter Color L values are not within the 0.3 units, discard those felt/cardboard combinations outside the limit. Prepare new samples and repeat the Hunter Color L measurement until all samples are within 0.3 units of one another.

For the rubbing of the web sample/cardboard combinations, secure a prepared web sample card on the base plate of the rub tester by slipping the holes in the board over the hold-down pins. Clip a prepared felt covered card (with established initial "L" reading) onto the four-pound weight by pressing the card ends evenly under the clips on the sides of the weight. Make certain the card is centered score bend to score bend on the weight, positioned flat against the rubber pads, with the felt side facing away from the rubber pads. Hook the weight onto the tester arm and gently lower onto the prepared web sample card. It is important to check that the felt is resting flat on the web sample and that the weight does not bind on the arm.

Next, activate the tester allowing the weighted felt test strip to complete five full rubbing strokes against the web sample surface. At the end of the five strokes the tester will automatically stop. Remove the weight with the felt covered cardboard. Inspect the web sample. If torn, discard the felt and web sample and start over. If the web sample is intact, remove the felt covered cardboard from the weight. Measure the Hunter Color L value on the felt covered cardboard in the same location as described above for the blank felts. Record the Hunter Color L readings for the felt after rubbing. Rub, measure, and record the Hunter Color L values for all remaining samples. After all web specimens have been measured, remove and discard all felt. Felts strips are not used again. Cardboards are used until they are bent, torn, limp, or no longer have a smooth surface.

vii. Calculations

For samples measured on both surfaces, subtract the average initial L reading found for the unused felts from each of the three first-side surface L readings and each of the three second-side surface L readings. Calculate the average delta for the three first-side surface values. Calculate the average delta for the three second-side surface values. Finally, calculate the average of the lint value on the first-side surface and the second-side surface, and record as the lint value to the nearest whole unit.

For samples measured on only one surface, subtract the average initial L reading found for the unused felts from each of the three L readings. Calculate the average delta L for the three surface values and record as the lint value to the nearest whole unit.

Absorbency Test Method (Horizontal Full Sheet (HFS)):

The Horizontal Full Sheet (HFS) test method determines the amount of distilled water absorbed and retained by a sanitary toilet tissue product of the present invention. This method is performed by first weighing a sample of the sanitary toilet tissue product to be tested (referred to herein as the "Dry Weight of the paper"), then thoroughly wetting the sanitary toilet tissue product, draining the wetted sanitary toilet tissue product in a horizontal position and then reweighing (referred to herein as "Wet Weight of the paper"). The absorptive capacity of the sanitary toilet tissue product is then computed as the amount of water retained in units of grams of water absorbed by the sanitary toilet tissue product. When evaluating different sanitary toilet tissue product samples, the same size of sanitary toilet tissue product is used for all samples tested.

The apparatus for determining the HFS capacity of sanitary toilet tissue product comprises the following: an electronic balance with a sensitivity of at least ±0.01 grams and a minimum capacity of 1200 grams. The balance should be positioned on a balance table and slab to minimize the vibration effects of floor/benchtop weighing. The balance should also have a special balance pan to be able to handle the size of the sanitary toilet tissue product tested (i.e.; a paper sample of about 11 in. (27.9 cm) by 11 in. (27.9 cm)). The balance pan can be made out of a variety of materials. Plexiglass is a common material used.

A sample support rack and sample support cover is also required. Both the rack and cover are comprised of a lightweight metal frame, strung with 0.012 in. (0.305 cm) diameter monofilament so as to form a grid of 0.5 inch squares (1.27 $cm^2$). The size of the support rack and cover is such that the sample size can be conveniently placed between the two.

The HFS test is performed in an environment maintained at 23±1° C. and 50±2% relative humidity. A water reservoir or tub is filled with distilled water at 23±1° C. to a depth of 3 inches (7.6 cm).

The sanitary toilet tissue product to be tested is carefully weighed on the balance to the nearest 0.01 grams. The dry weight of the sample is reported to the nearest 0.01 grams. The empty sample support rack is placed on the balance with the special balance pan described above. The balance is then zeroed (tared). The sample is carefully placed on the sample support rack. The support rack cover is placed on top of the support rack. The sample (now sandwiched between the rack and cover) is submerged in the water reservoir. After the sample has been submerged for 60 seconds, the sample support rack and cover are gently raised out of the reservoir.

The sample, support rack and cover are allowed to drain horizontally for 120±5 seconds, taking care not to excessively shake or vibrate the sample. Next, the rack cover is carefully removed and the wet sample and the support rack are weighed on the previously tared balance. The weight is recorded to the nearest 0.01 g. This is the wet weight of the sample.

The gram per sanitary toilet tissue product sample absorptive capacity of the sample is defined as (Wet Weight of the paper−Dry Weight of the paper).

"Roll Density" Test Method

For this test, the rolled paper product roll is the test sample. Remove all of the test rolled paper product rolls from any packaging and allow them to condition at about 23° C.±2 C.° and about 50%±2% relative humidity for 24 hours prior to testing. Rolls with cores that are crushed, bent or damaged should not be tested.

The Roll Density is calculated by dividing the mass of the roll by its volume using the following equation:

$$\text{Roll Density}\left(\frac{g}{cm^3}\right) = \frac{\text{Mass (g)}}{\text{Roll Width (cm)}\cdot\pi\left[\text{Outer Radius (cm)}^2 - \text{Inner Radius (cm)}^2\right]}$$

FIG. 9 visually describes the measurement of a rolled paper product roll 10 where Z is the center axis of the roll, where the outer radius $r_2$ in units of cm is measured using the Roll Diameter Test Method described herein, the inner radius $r_1$ in units of cm is measured using a caliper tool inside the core, the roll width W is measured using a ruler or tape measure in units of cm and the mass in units of g is the weight of the entire roll including core.

In like fashion analyze a total of ten (10) replicate sample rolls. Calculate the arithmetic mean of the 10 values and report the Roll Density to the nearest 0.001 g/cm$^3$.

"Roll Diameter" Test Method

For this test, the actual rolled paper product roll is the test sample. Remove all of the test rolled paper product rolls from any packaging and allow them to condition at about 23° C.±2 C.° and about 50%±2% relative humidity for 24 hours prior to testing. Rolls with cores that are crushed, bent or damaged should not be tested.

The diameter of the test rolled paper product roll is measured directly using a Pi® tape of appropriate length or equivalent precision diameter tape (e.g. an Executive Diameter tape available from Apex Tool Group, LLC, Apex, NC, Model No. W606PD) which converts the circumferential distance into a diameter measurement, so the roll diameter is directly read from the scale. The diameter tape is graduated to 0.01 inch increments. The tape is 0.25 inches wide and is made of flexible metal that conforms to the curvature of the rolled paper product roll but is not elongated under the loading used for this test.

Loosely loop the diameter tape around the circumference of the test rolled paper product roll, placing the tape edges directly adjacent to each other with the surface of the tape lying flat against the test rolled paper product roll. Pull the tape snug against the circumference of the test rolled paper product roll, applying approximately 100 g of force. Wait 3 seconds. At the intersection of the diameter tape, read the diameter aligned with the zero mark of the diameter tape and record as the Roll Diameter to the nearest 0.01 inches. The outer radius of the rolled paper product roll is also calculated from this test method.

In like fashion analyze a total of ten (10) replicate sample rolled paper product rolls. Calculate the arithmetic mean of the 10 values and report the Roll Diameter to the nearest 0.01 inches.

"Roll Firmness" Test Method for Toilet Tissue Roll and Paper Towel Roll Samples

Roll Firmness is measured on a constant rate of extension tensile tester with computer interface (a suitable instrument is the MTS Alliance using Testworks 4.0 Software, as available from MTS Systems Corp., Eden Prairie, MN) using a load cell for which the forces measured are within 10% to 90% of the limit of the cell. The roll product is held horizontally, a cylindrical probe is pressed into the test roll, and the compressive force is measured versus the depth of penetration. All testing is performed in a conditioned room maintained at 23° C.±2 C° and 50%±2% relative humidity.

Figure 6:
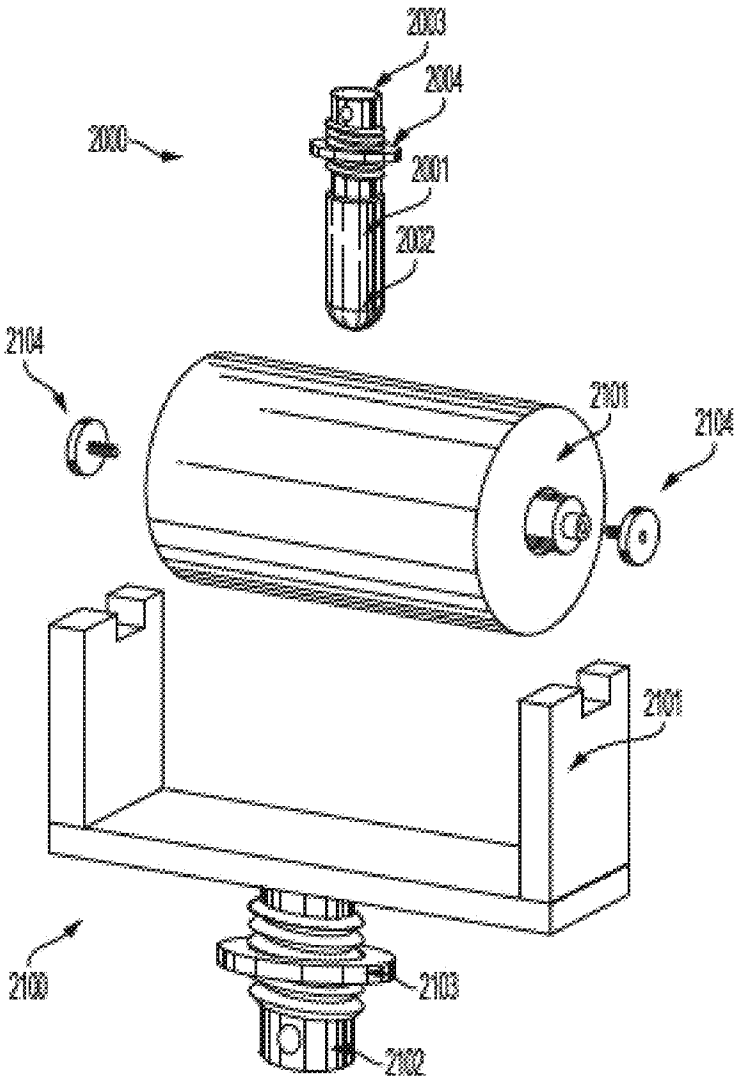
FIG. 6 is a schematic representation of the testing device used in the Roll Firmness measurement.

Referring to FIG. 6, the upper movable fixture 2000 consist of a cylindrical probe 2001 made of machined aluminum with a 19.00±0.05 mm diameter and a length of 38 mm. The end of the cylindrical probe 2002 is hemispheric (radius of 9.50±0.05 mm) with the opposing end 2003 machined to fit the crosshead of the tensile tester. The fixture includes a locking collar 2004 to stabilize the probe and maintain alignment orthogonal to the lower fixture. The lower stationary fixture 2100 is an aluminum fork with vertical prongs 2101 that supports a smooth aluminum sample shaft 2101 in a horizontal position perpendicular to the probe. The lower fixture has a vertical post 2102 machined to fit its base of the tensile tester and also uses a locking collar 2103 to stabilize the fixture orthogonal to the upper fixture.

The sample shaft 2101 has a diameter that is 85% to 95% of the inner diameter of the roll and longer than the width of the roll. The ends of sample shaft are secured on the vertical prongs with a screw cap 2104 to prevent rotation of the shaft during testing. The height of the vertical prongs 2101 should be sufficient to assure that the test roll does not contact the horizontal base of the fork during testing. The horizontal distance between the prongs must exceed the length of the test roll.

Program the tensile tester to perform a compression test, collecting force and crosshead extension data at an acquisition rate of 100 Hz. Lower the crosshead at a rate of 10 mm/min until 5.00 g is detected at the load cell. Set the current crosshead position as the corrected gage length and zero the crosshead position. Begin data collection and lower the crosshead at a rate of 50 mm/min until the force reaches 10 N. Return the crosshead to the original gage length.

Remove all of the test rolls from their packaging and allow them to condition at about 23° C.±2 C.° and about 50%±2% relative humidity for 2 hours prior to testing. Rolls with cores that are crushed, bent or damaged should not be tested. Insert sample shaft through the test roll's core and then mount the roll and shaft onto the lower stationary fixture. Secure the sample shaft to the vertical prongs then align the midpoint of the roll's width with the probe. Orient the test roll's tail seal so that it faces upward toward the probe. Rotate the roll 90 degrees toward the operator to align it for the initial compression.

Position the tip of the probe approximately 2 cm above the surface of the sample roll. Zero the crosshead position and load cell and start the tensile program. After the crosshead has returned to its starting position, rotate the roll toward the operator 120 degrees and in like fashion acquire a second measurement on the same sample roll.

From the resulting Force (N) verses Distance (mm) curves, read the penetration at 7.00 N as the Roll Firmness and record to the nearest 0.1 mm. In like fashion analyze a total of ten (10) replicate sample rolls. Calculate the arithmetic mean of the 20 values and report Roll Firmness to the nearest 0.1 mm.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited.

The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A retail store shelf array of disposable, fibrous, rolled products, comprising:

a first package comprising a first front face disposed as aisle facing, the first package comprising a first plurality of disposable, fibrous, rolled products, the first plurality of disposable, fibrous, rolled products comprising a first average roll diameter of 6.6 inches or less;

a second package comprising a second front face disposed as aisle facing, the second package comprising a second plurality of disposable, fibrous, rolled products, the second plurality of disposable, fibrous, rolled products comprising a second average roll diameter of 6.7 inches or greater;

a third package comprising a third front face disposed as aisle facing, the third package comprising a third plurality of disposable, fibrous, rolled products, the third plurality of disposable, fibrous, rolled products comprising a third average roll diameter of 6.6 inches or less;

wherein the second package is disposed between the first and third packages, such that the disposable, fibrous, rolled products comprising an average roll diameter of 6.6 inches or less flank the disposable, fibrous, rolled products comprising an average roll diameter of 6.7 inches or greater;

wherein the second front face has a larger surface area than the first and third front faces;

wherein the first, second, and third packages comprise the same brand name.

2. The array of claim 1, wherein the rolled products of the third package have a smaller average roll diameter than the rolled products of the first package.

3. The array of claim 2, wherein the third package is disposed immediately adjacent to the second package.

4. The array of claim 3, wherein the first package is disposed immediately adjacent to the second package.

5. The array of claim 1, wherein a plurality of second packages are arranged up and down or side-to-side.

6. The array of claim 5, wherein the plurality of second packages are centered between other packages making up the array.

7. The array of claim 6, wherein the plurality of second packages are centered up and down.

8. The array of claim 6, wherein the plurality of second packages are centered side-to-side.

9. The array of claim 1, further comprising a fourth package comprising a fourth front face disposed as aisle facing, the fourth package comprising a fourth plurality of disposable, fibrous, rolled products, the fourth plurality of disposable, fibrous, rolled products comprising a fourth average roll diameter of 6.6 inches or less.

10. The array of claim 9, wherein the rolled products of the fourth package have a larger average roll diameter than the rolled products of the first and third packages.

11. The array of claim 10, wherein the fourth package is not disposed immediately adjacent to the second package.

12. The array of claim 11, further comprising a fifth package comprising a fifth front face disposed as aisle facing, the fifth package comprising a fifth plurality of disposable, fibrous, rolled products, the fifth plurality of disposable, fibrous, rolled products comprising a fifth average roll diameter of 6.6 inches or less.

13. The array of claim 12, wherein the rolled products of the fifth package have a greater average roll diameter than the rolled products of the first, third, and fourth packages.

14. The array of claim 13, wherein the fifth package is not disposed immediately adjacent to the second package.

15. The array of claim 14, wherein the fifth package is disposed opposite of the fourth package such that the fourth and fifth packages flank the array.

16. The array of claim 15, wherein the fourth and fifth packages flank the array along a top and a bottom, respectively, or wherein the fourth and fifth packages flank the array along the bottom and the top, respectively.

17. The array of claim 15, wherein the fourth and fifth packages flank the array along sides of the array.

18. The array of claim 12, wherein the first, second, third, fourth, and fifth front faces each comprise first, second, third, fourth, and fifth brand indicia, respectively, and wherein each of the first, second, third, fourth, and fifth front faces each comprise a first, second, third, fourth, and fifth face-to brand indicia ratio, respectively, wherein the second face-to brand indicia ratio is greater than the face-to brand indicia ratio of the fourth front face.

19. The array of claim 12, wherein the first, second, third, fourth, and fifth front faces each comprise first, second, third, fourth, and fifth brand indicia, respectively, and wherein each of the first, second, third, fourth, and fifth front faces each comprise a first, second, third, fourth, and fifth Face-to-Brand Indicia Ratio, respectively, wherein the second Face-to-Brand Indicia Ratio is greater than the Face-to-Brand Indicia Ratio of the fifth front face.

20. The array of claim 12, wherein the first, second, third, fourth, and fifth front faces each comprise first, second, third, fourth, and fifth brand indicia, respectively, and wherein each of the first, second, third, fourth, and fifth front faces each comprise a first, second, third, fourth, and fifth face-to brand indicia ratio, respectively, wherein the second face-to brand indicia ratio is greater than the face-to brand indicia ratio of at least one of the fourth and fifth front faces.

21. The array of claim 12, wherein each of the second, fourth, and fifth front faces each comprise second, fourth, and fifth additional information indicia, respectively, and wherein each of the second, fourth, and fifth additional information indicia have a surface area, wherein the surface area of the second additional information indicia on the second front face is greater than at least one of the fourth and fifth surface areas of the fourth and fifth additional information indicia on the fourth and fifth front faces.

22. The array of claim 1, wherein each of the packages of the array have the same color pallet and design architecture.

* * * * *